US007131876B2

(12) United States Patent
Hattori et al.

(10) Patent No.: US 7,131,876 B2
(45) Date of Patent: Nov. 7, 2006

(54) CONTROL DEVICE FOR SMALL WATERCRAFT

(75) Inventors: Toshiyuki Hattori, Hamamatsu (JP); Sumihiro Takashima, Hamamatsu (JP); Syu Akuzawa, Hamamatsu (JP); Kazumasa Ito, Hamamatsu (JP)

(73) Assignee: Yamaha Marine Kabushiki Kaisha, Hamamatsu (JP)

( * ) Notice: Subject to any disclaimer, the term of this patent is extended or adjusted under 35 U.S.C. 154(b) by 88 days.

(21) Appl. No.: 10/909,938

(22) Filed: Aug. 2, 2004

(65) Prior Publication Data

US 2005/0208844 A1 Sep. 22, 2005

(30) Foreign Application Priority Data

Mar. 22, 2004 (JP) ..... 2004-081930

(51) Int. Cl.
*B63H 21/22* (2006.01)

(52) U.S. Cl. ..... 440/1; 440/84

(58) Field of Classification Search ..... 440/1, 440/84; 441/80; 123/319, 342, 344, 361, 123/396, 399; 340/426.12
See application file for complete search history.

(56) References Cited

U.S. PATENT DOCUMENTS

| | | | | |
|---|---|---|---|---|
| 4,853,504 | A | 8/1989 | Tanaka et al. | |
| 4,941,854 | A | 7/1990 | Takahashi et al. | |
| 5,319,698 | A | 6/1994 | Glidewell et al. | |
| 5,593,330 | A | 1/1997 | Kobayashi | |
| 5,623,245 | A * | 4/1997 | Gilmore | 340/426.12 |
| 5,725,228 | A | 3/1998 | Livingston | |
| 5,854,736 | A | 12/1998 | Fuhs et al. | |
| 5,860,842 | A * | 1/1999 | Parr | 441/80 |
| 6,077,133 | A | 6/2000 | Kojima et al. | |
| 6,125,782 | A | 10/2000 | Takashima et al. | |
| 6,352,045 | B1 * | 3/2002 | Takashima | 440/1 |
| 6,404,071 | B1 | 6/2002 | Kurano | |
| 6,695,657 | B1 * | 2/2004 | Hattori | 440/84 |
| 6,878,019 | B1 * | 4/2005 | Kanno et al. | 440/1 |
| 6,889,654 | B1 * | 5/2005 | Ito | 123/396 |
| 2002/0053310 | A1 | 5/2002 | Ibata et al. | |
| 2003/0089291 | A1 | 5/2003 | Kanno et al. | |
| 2004/0198106 | A1 | 10/2004 | Tsumiyama et al. | |

FOREIGN PATENT DOCUMENTS

| | | |
|---|---|---|
| EP | 1 069 012 A2 | 1/2001 |
| JP | 2001-254549 | 9/2001 |

OTHER PUBLICATIONS

Photograph of Safety Lanyard Cap and Float From 2001 Seadoo RXDI.
SeaDoo 2003 shop Manual; pp. 1-7; @Bombardier Inc. 2003.
Copending U.S. Appl. No. 10/862,823, filed Jun. 7, 2004, entitled "Security System for Watercraft".

* cited by examiner

*Primary Examiner*—Lars A. Olson
(74) *Attorney, Agent, or Firm*—Knobbe, Martens, Olson & Bear LLP

(57) ABSTRACT

A watercraft has an engine that is controlled by an electronic control unit and the watercraft includes a security system. The security system includes a portable transmitter unit, and also includes a mounted receiver. The portable unit is waterproof and is buoyant. The portable unit includes a housing of transparent material that allows a user to see whether water has entered the portable unit. The security system has an antenna that provides improved reception between the portable transmitter unit and the mounted receiver.

17 Claims, 20 Drawing Sheets

CONTROL DEVICE FOR SMALL WATERCRAFT

PRIORITY INFORMATION

This application is based on and claims priority to Japanese Patent Application No. 2004-081930, filed Mar. 22, 2004, the entire content of which is hereby expressly incorporated by reference.

BACKGROUND OF THE INVENTION

1. Field of the Invention

The present invention generally relates to a control system for controlling a marine engine, and more particularly relates to an improved control system that controls a marine engine using a security system that has various modes of operation and that includes a transmitter and a receiver.

2. Description of the Related Art

Watercraft have been provided with an automatic control system using a transmitter that can remotely communicate with a receiver on the watercraft to allow an engine of the watercraft to start. Typically, an ID code is applied to identify whether a transmitter is the true key that is accessible to an associated receiver. Unless the system determines that the ID code is true, the person who has tried to use the key is not allowed to start the engine. Japanese Patent Publication No. 2001-254549 discloses examples of such watercraft systems.

Small watercraft employ an engine to power the vehicle. For example, in a personal watercraft (PWC), a hull of the watercraft typically defines a rider's area above an engine compartment. An internal combustion engine powers a jet propulsion unit that propels the watercraft by discharging water rearward. The engine lies within the engine compartment in front of a tunnel, which is formed on an underside of the hull. At least part of the jet propulsion unit is placed within the tunnel and includes an impeller that is driven by the engine.

SUMMARY OF THE INVENTION

One aspect of embodiments described herein is a watercraft that includes a hull, a seat, a control mast, and an engine disposed within the hull. The watercraft includes a controller that communicates with at least one engine parameter and that is configured to control engine operation. A security system in the watercraft is configured to communicate with the engine controller. A receiver communicates with the security system. A portable transmitter transmits at least one signal to the receiver. The portable transmitter comprises at least one sealed airtight cavity that maintains a density of the portable transmitter below the density of water. The security system determines how the engine controller controls the engine in response to a signal received from the receiver. The receiver is located in a remote location above the water level of the watercraft and adjacent to an access opening.

In certain embodiments, the signal sent by the transmitter is a signal that prohibits engine operation. In other embodiments, the signal sent by the transmitter is a signal that permits engine operation. In other embodiments, the signal sent by the transmitter is a signal that limits engine operation.

Preferably, the transmitter is removably mounted to the watercraft and the transmitter communicates by radio waves with the receiver. In particular embodiments, the transmitter is rectangular. The transmitter preferable includes a transmitter housing that is at least partially transparent.

Preferably, the receiver has an antenna that extends from the receiver. In certain embodiments, the antenna is formed in a substantially closed loop configuration. Also preferably, the antenna includes a connector to extend the antenna.

Another aspect in accordance with embodiments disclosed herein is a watercraft that includes a hull, a seat, a control mast, and an engine disposed within the hull. The watercraft includes a controller that communicates with at least one engine parameter and that is configured to control engine operation. A security system in the watercraft is configured to communicate with the engine controller. A receiver in the watercraft communicates with the security system. A portable transmitter transmits at least one signal to the receiver. The portable transmitter comprises a housing that it is at least partially transparent. The security system determines how the engine controller controls the engine in response to a signal received from the receiver. The receiver is located in a remote location above the water level of the watercraft and adjacent to an access opening.

In one preferred embodiment, the signal sent by the transmitter is a signal that prohibits engine operation. In another preferred embodiment, the signal sent by the transmitter is a signal that permits engine operation. In another preferred embodiment, the signal sent by the transmitter is a signal that limits engine operation.

Preferably, the transmitter is rectangular. Also preferably, the transmitter is buoyant. In certain preferred embodiments, the transmitter is removably mounted to the watercraft, and the transmitter communicates by radio waves with the receiver.

Further aspects, features and advantages of this invention will become apparent from the detailed description of the preferred embodiments which follow.

BRIEF DESCRIPTION OF THE DRAWINGS

The foregoing features, aspects, and advantages of the present invention are described below with reference to the drawings of several preferred embodiments that are intended to illustrate and not to limit the invention, in which.

DETAILED DESCRIPTION OF THE PREFERRED EMBODIMENT

An overall configuration of an embodiment of a personal watercraft 10 is described below in connection with FIGS. 1–4. The watercraft 10 advantageously employs a security system 11, which is configured in accordance with features, aspects and advantages of the present invention. The described control system configuration has particular utility for use with personal watercraft, and is described in the context of personal watercraft. The control system is not limited to use with personal watercraft, and can be applied to other types of watercraft, such as, for example, small jet boats and other vehicles.

Figure 1:
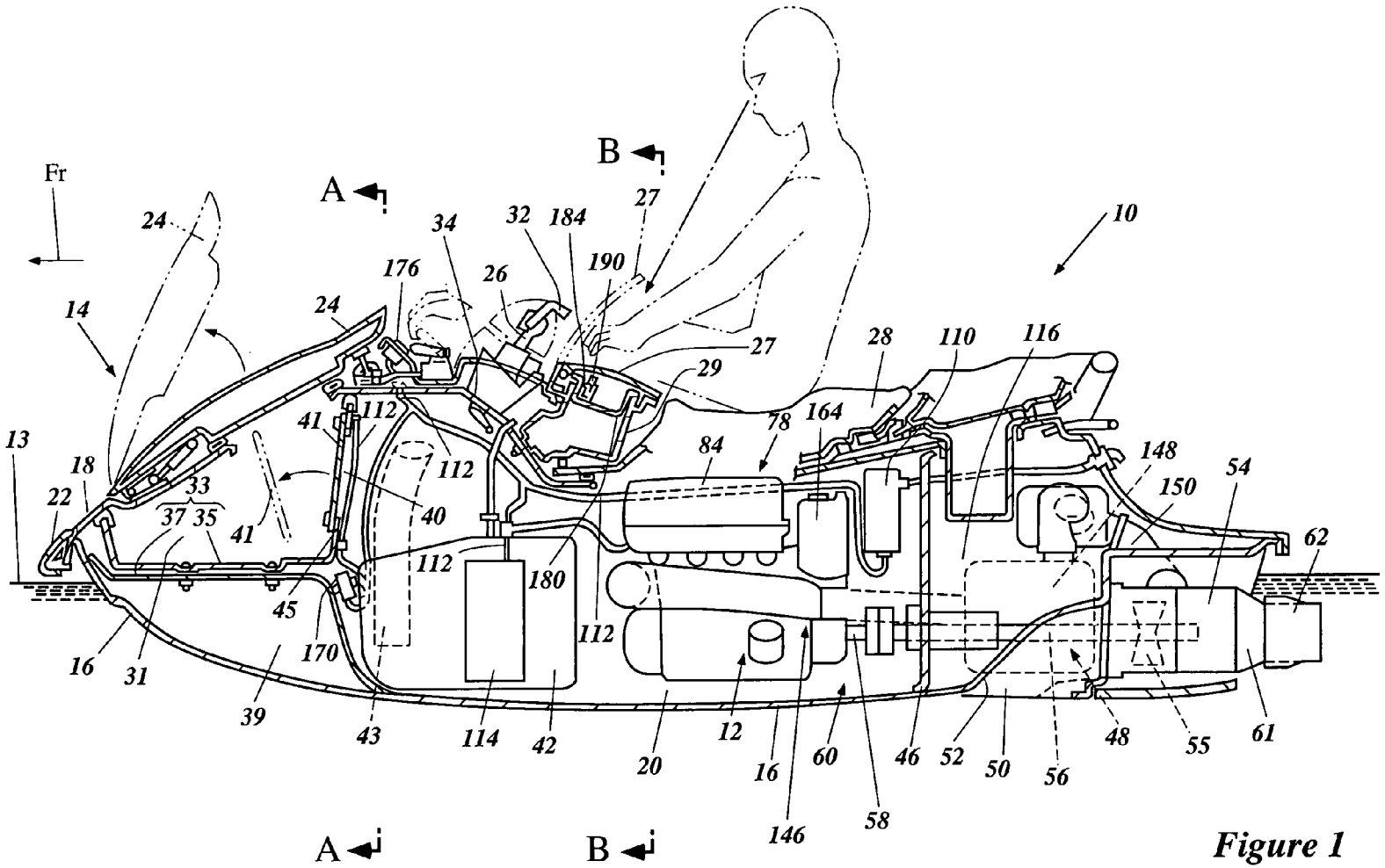
FIG. 1 is a side elevational and sectioned view of an engine-powered personal watercraft that has a security system comprising a receiver and a portable transmitter unit that are arranged and configured in accordance with certain features, aspects and advantages of the present invention.
Figure 2:
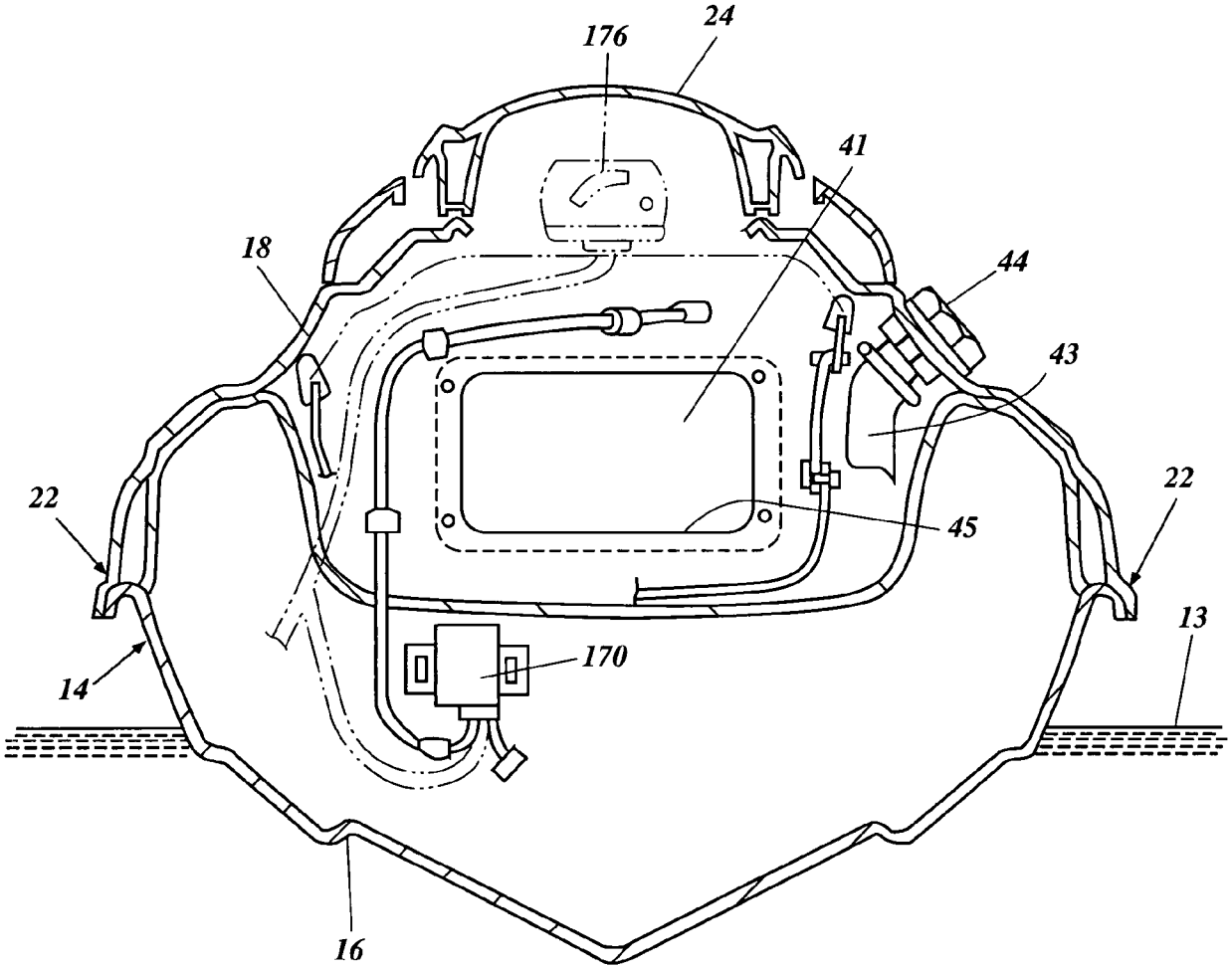
FIG. 2 is a front sectioned view of the watercraft of FIG. 1 taken along the line A—A of FIG. 1.
Figure 3:
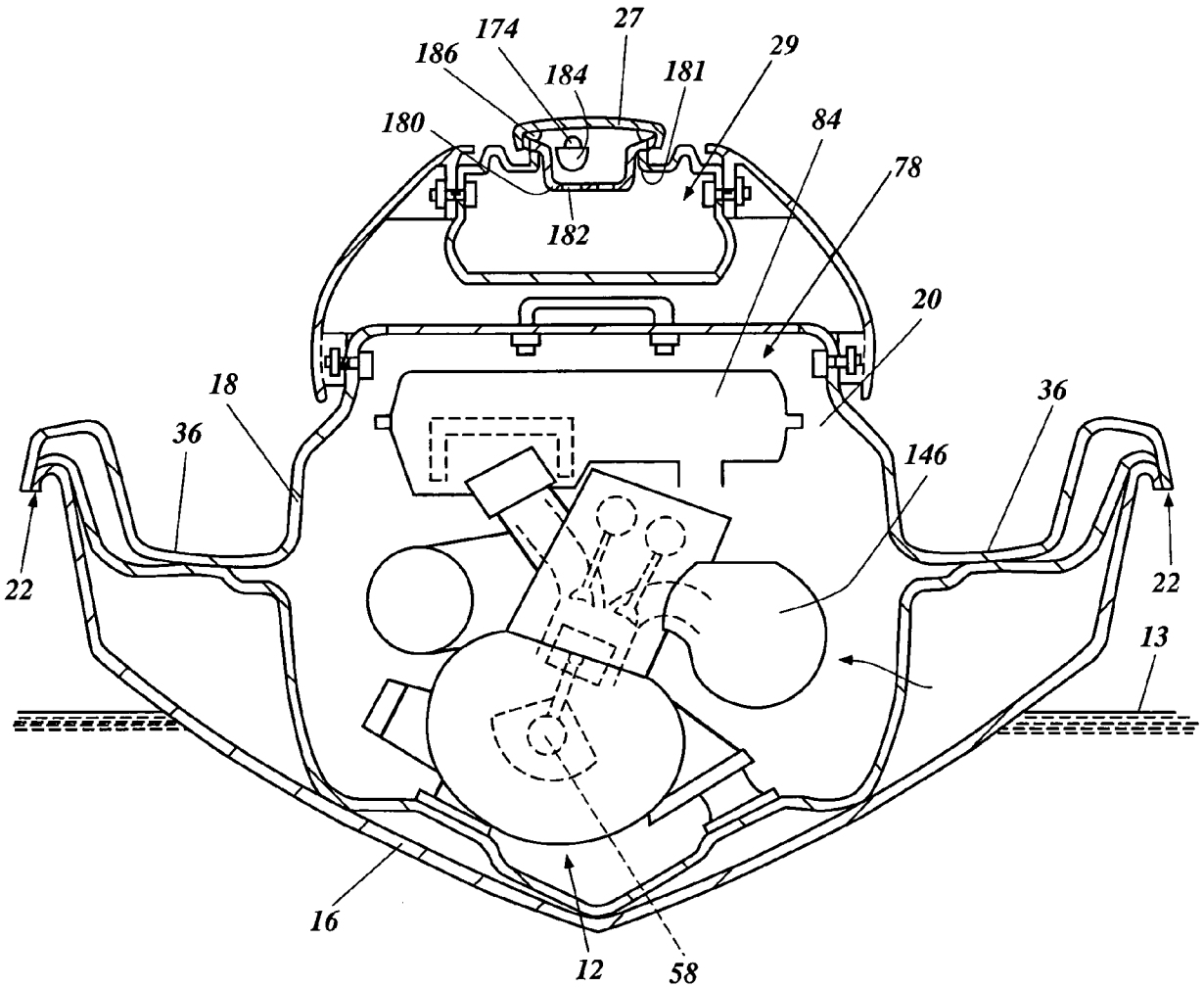
FIG. 3 is a front sectioned view of the watercraft of FIG. 1 taken along the line B—B of FIG. 1.

As shown in FIG. 1, the personal watercraft 10 is designed to travel on a body of water 13. As such, the watercraft 10 includes a hull 14 formed with a lower hull section 16 and an upper hull section or deck 18. The lower hull section 16 and the upper hull section 18 preferably are coupled together to define an internal cavity 20. A bond flange 22 defines an intersection of the two hull sections 16, 18.

The illustrated upper hull section 18 preferably comprises a hatch cover 24, a control mast 26, a smaller hatch cover 27, and a seat 28, which are arranged generally in series from fore to aft. In the illustrated arrangement, a forward portion of the upper hull section 18 defines a bow portion 30 that slopes upwardly.

A forward bulkhead 33 is formed within the hull. Preferably, a storage compartment 31 is positioned proximate the forward bulkhead 33. In the illustrated arrangement, a lower surface 35 of the storage compartment 31 rests on a generally horizontal surface 37 of the forward bulkhead 33. A downwardly sloping surface preferably is located rearward of the surface 37. A lower hull cavity 39 is positioned generally beneath the forward bulkhead 33 and, more particularly, generally beneath the generally horizontal surface 37.

A maintenance opening 40 is advantageously defined through a wall of the storage compartment 31. In one arrangement, the maintenance opening 40 is defined through a rear wall of the storage compartment. The opening 40 preferably is sufficiently large to allow maintenance of portions of the security system 11, which is described in greater detail below. More preferably, the opening 40 is sufficiently large to allow the serviced components to be removed from the watercraft through the opening 40.

An opening is advantageously provided through the bow portion 30 so the rider can access the internal storage compartment 31. An access lid 41 is securely attached through fasteners 43 to an upper support 45 of the storage compartment 31. The lid 41 is designed to close the opening 40. Preferably, the lid 41 seals or substantially seals the opening 40. More preferably, when the lid 41 is closed, a substantially watertight seal is formed over the opening 40. As discussed above, removal of the lid 41 allows access to a front portion of the internal cavity 20.

The hatch cover 24 is detachably affixed or hinged to the bow portion 30 to cover the opening in the hull that provides access to the storage compartment 31 or the corresponding region of the watercraft. The smaller hatch cover 27 allows access to a second, smaller storage compartment 29 that lies generally between the control mast 26 and the seat 28.

Figure 13:
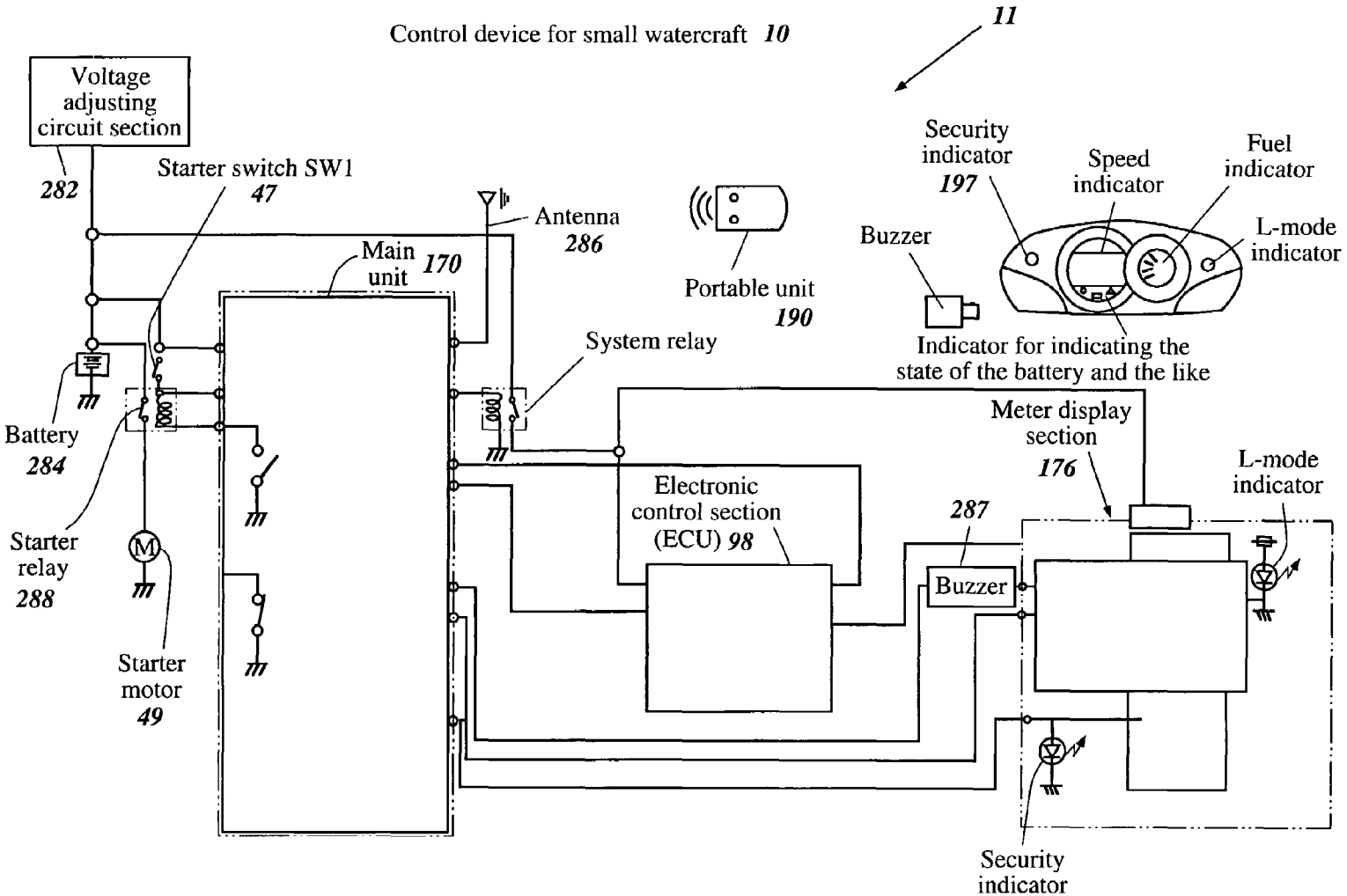
FIG. 13 is a schematic diagram that illustrates the control device for the watercraft, wherein various components are shown, including a main unit, an electronic control section, and a security indicator.

The control mast 26 extends upwardly and supports a handle bar 32 through a steering bracket 34. The handle bar 32 is provided primarily for controlling the direction of the watercraft 10. The handle bar 32 preferably carries other mechanisms, such as, for example, a throttle lever (not shown) that is used to control the engine output (i.e., to vary the engine speed) and a starter switch 47 that is used to initiate a starter motor 49 (FIG. 13). The watercraft also advantageously comprises a power switch, which energizes the electrical systems when turned on. Furthermore, at least one buzzer and at least one light are advantageously provided so that the operator can hear the buzzer and see the light when the watercraft is ready for boarding and during operation. In some embodiments, an LED display is also used.

The seat 28 extends rearwardly from a portion just rearward of the bow portion 30. In the illustrated arrangement, the seat 28 has a saddle shape. Hence, a rider can sit on the seat 28 in a straddle fashion.

Foot areas 36 are defined on both sides of the seat 28 along a portion of the top surface of the upper hull section 18. The foot areas 36 are formed generally flat but may be inclined toward a suitable drain configuration.

fuel tank 42 is positioned in the cavity 20 under the bow portion 30 of the upper hull section 18 in the illustrated arrangement. A duct 43 preferably couples the fuel tank 42 with a fuel inlet port positioned at a top surface of the bow 30 of the upper hull section 18. A closure cap 44 (FIG. 2) closes the fuel inlet port to inhibit water infiltration.

An engine 12 is disposed in an engine compartment that is defined, for example, within the cavity 20. The engine compartment preferably is located under the seat 28, but other locations are also possible (e.g., beneath the control mast or in the bow). In the illustrated configuration, the engine compartment is defined within the cavity 20 by the forward bulkhead 33 and a rearward bulkhead 46.

A jet pump unit 48 propels the illustrated watercraft 10. Other types of marine drives can be used depending upon the application. The jet pump unit 48 preferably is disposed within a tunnel 50 formed on the underside of the lower hull section 16. The tunnel 50 has a downward facing inlet port 52 opening toward the body of water. A jet pump housing 54 is disposed within a portion of the tunnel 50. Preferably, an impeller 55 is supported within the jet pump housing 54.

An impeller shaft 56 extends forwardly from the impeller and is coupled with a crankshaft 58 of the engine 12 by a suitable coupling device 60. The crankshaft 58 of the engine 12 thus drives the impeller shaft 56. The rear end of the housing 54 defines a discharge nozzle 61. A steering nozzle 62 is affixed proximate the discharge nozzle 61. The steering nozzle 62 is pivotally movable about a generally vertical steering axis. The steering nozzle 62 is connected to the handle bar 32 by a cable or other suitable arrangement so that the rider can pivot the nozzle 62 for steering the watercraft.

The engine 12 in the illustrated arrangement operates on a four-stroke cycle combustion principal. The engine 12 is an inclined L4 (in-line four cylinder) type. The illustrated engine, however, merely exemplifies one type of engine on which various aspects and features of the present invention can be used. Engines having a different number of cylinders, other cylinder arrangements, other cylinder orientations (e.g., upright cylinder banks, V-type, W-type, and opposing), and operating on other combustion principles (e.g., crankcase compression two-stroke, diesel, and rotary) are all practicable. Many orientations of the engine are also possible (e.g., with a transversely or vertically oriented crankshaft).

The engine 12 preferably includes an air induction system 78 to guide air to the engine 12. The illustrated air induction system includes an air intake box 84 for smoothing intake airflow and acting as an intake silencer. The intake box 84 in the illustrated embodiment is generally rectangular. Other shapes of the intake box of course are possible.

One advantageous arrangement includes an electronic control unit 98 (ECU), such as, for example, a microcomputer. The ECU 98 preferably comprises a microcontroller having a central processing unit (CPU), a timer, and memory storage. The memory storage comprises at least an electrically erasable programmable read only memory (EEPROM); however, the memory storage may also advantageously include random access memory (RAM) or other suitable storage devices. Other suitable configurations of the ECU 98 also can be used. Preferably, the ECU 98 is configured with or capable of accessing various maps to control engine operation in a suitable manner. The ECU 98 advantageously includes a communication device that provides at least one way communication from the security system 11. The communication device preferably comprises an interface that receives from and transmits to other devices connected to the ECU 98 data signals, including the control system 11, which is described in detail below.

In the illustrated arrangement, the ECU 98 is advantageously housed in an electrical component box 110 and communicates through a cable 112 with various electrical devices including, but not limited to, the security system 11 and electrical subsystems of the engine 12. The electrical component box 110 is preferably located behind the engine 12 underneath the seat 28. Although other locations for the electrical box 110 are possible, the location behind the engine 12 and underneath the seat 28 provides an area well protected from water intrusion.

The engine 12 also includes a fuel injection system which preferably includes four fuel injectors (not shown), each having an injection nozzle exposed to intake ports (not shown) so that injected fuel is directed toward combustion chambers (not shown). Thus, in the illustrated arrangement, the engine 12 features port fuel injection. It is anticipated that various features, aspects and advantages of the present invention also can be used with direct or other types of indirect fuel injection systems.

Fuel is drawn from the fuel tank 42 through a fuel pump 114 and delivered to the fuel injectors. Excess fuel that is not injected by the fuel injector can be returned to the fuel tank 42. In operation, a predetermined amount of fuel is sprayed into the engine 12 via the injection nozzles of the fuel injectors. The timing and duration of the fuel injection is dictated by the ECU 98 based upon any desired control strategy.

The engine 12 further includes an ignition system (not shown). In the illustrated arrangement, four spark plugs (not shown) are fixed on a cylinder head member (not shown). The spark plugs ignite an air/fuel charge just prior to, or during, each power stroke, preferably under the control of the ECU 98 to ignite the air/fuel charge therein.

The engine 12 further includes an exhaust system to discharge burnt charges, i.e., exhaust gases, from the Engine 12. An exhaust pipe 146 extends rearwardly along a port side surface of the engine 12. The exhaust pipe 146 is connected to a water-lock 148 proximate a forward surface of the water-lock 148. The water-lock 148 is advantageously located in a rear cavity 116. A discharge pipe 150 extends from a top surface of the water-lock 148. The discharge pipe 150 bends transversely across the center plane and rearwardly toward a stern of the watercraft. Preferably, the discharge pipe 150 opens at a stern of the lower hull section 16 in a submerged position. As is known, the water-lock 148 generally inhibits water in the discharge pipe 150 or the water-lock itself from entering the exhaust pipe 146.

The engine 12 further includes a cooling system configured to circulate coolant into thermal communication with at least one component within the watercraft 10. Preferably, the cooling system is an open-loop type of cooling system that circulates water drawn from the body of water in which the watercraft 10 is operating through thermal communication with heat generating components of the watercraft 10 and the engine 12. Other types of cooling systems are advantageously used in other applications. For example, in certain applications, a closed-loop type liquid cooling system may advantageously be used to cool lubricant and other components.

The present cooling system preferably includes a water pump arranged to introduce water from the body of water surrounding the watercraft 10. The jet propulsion unit preferably is used as the water pump with a portion of the water pressurized by the impeller being drawn off for use in the cooling system, as is generally known in the art.

The engine 12 preferably includes a lubrication system that delivers lubricant oil to engine portions for inhibiting frictional wear of such portions. In the illustrated embodiment, a dry-sump lubrication system is employed. This system is a closed-loop type and includes an oil reservoir 164.

In order to determine appropriate engine operation control scenarios, the ECU 98 preferably uses control maps and/or indices stored within the ECU 98 in combination with data collected from various input sensors. The ECU's various input sensors are not shown; however, the sensors can include, but are not limited to, a throttle position sensor, a manifold pressure sensor, an engine coolant temperature sensor, an oxygen ($O_2$) sensor, and a crankshaft speed sensor.

It should be noted that the above-identified sensors merely correspond to some of the sensors that can be used for engine control and it is, of course, practicable to provide other sensors, such as an intake air pressure sensor, an intake air temperature sensor, a knock sensor, a neutral sensor, a watercraft pitch sensor, a shift position sensor and an atmospheric temperature sensor. The selected sensors can be provided for sensing engine running conditions, ambient conditions or other conditions of the engine 12 or associated watercraft 10.

During engine operation, ambient air enters the internal cavity 20 defined in the hull 14. The air is then introduced into the engine 12. At the same time, the fuel injectors spray fuel into the engine 12 under the control of ECU 98. Air/fuel charges are thus formed and delivered to the combustion chambers (now shown). The air/fuel charges are fired by the spark plugs under the control of the ECU 98. The burnt charges, i.e., exhaust gases, are discharged to the body of water surrounding the watercraft 10 through the exhaust system.

As discussed above, the watercraft desirably includes a security system 11. The security system 11 includes a main unit or receiver 170 that can be at least partially positioned behind and below the storage compartment 31. Removal of the lid 41 after opening the hatch cover 24 provides access to the main unit 170 through the access opening 41. The access lid 41 advantageously is hidden below the upper portion of the hatch cover 24 and can be removed, as indicated in dashed lines in FIG. 1.

The main unit 170 is mounted inside the cavity 20 and, in the illustrated arrangement, is completely out of view when the hatch cover 24 is in either an open position or a closed position when the access lid 41 is in the mounted position. The location of the main unit 170 is selected so that the main unit 170 is generally out of sight in order to inhibit unauthorized access to the main unit 170.

A wall in front of the control mast 26 advantageously supports various gauges of an instrument panel. For example, in the illustrated embodiment, a portion of the wall supports a security display 176. Other gauges can also be supported. In some embodiments, the security display 176 is supported by a display bracket.

Figure 4:
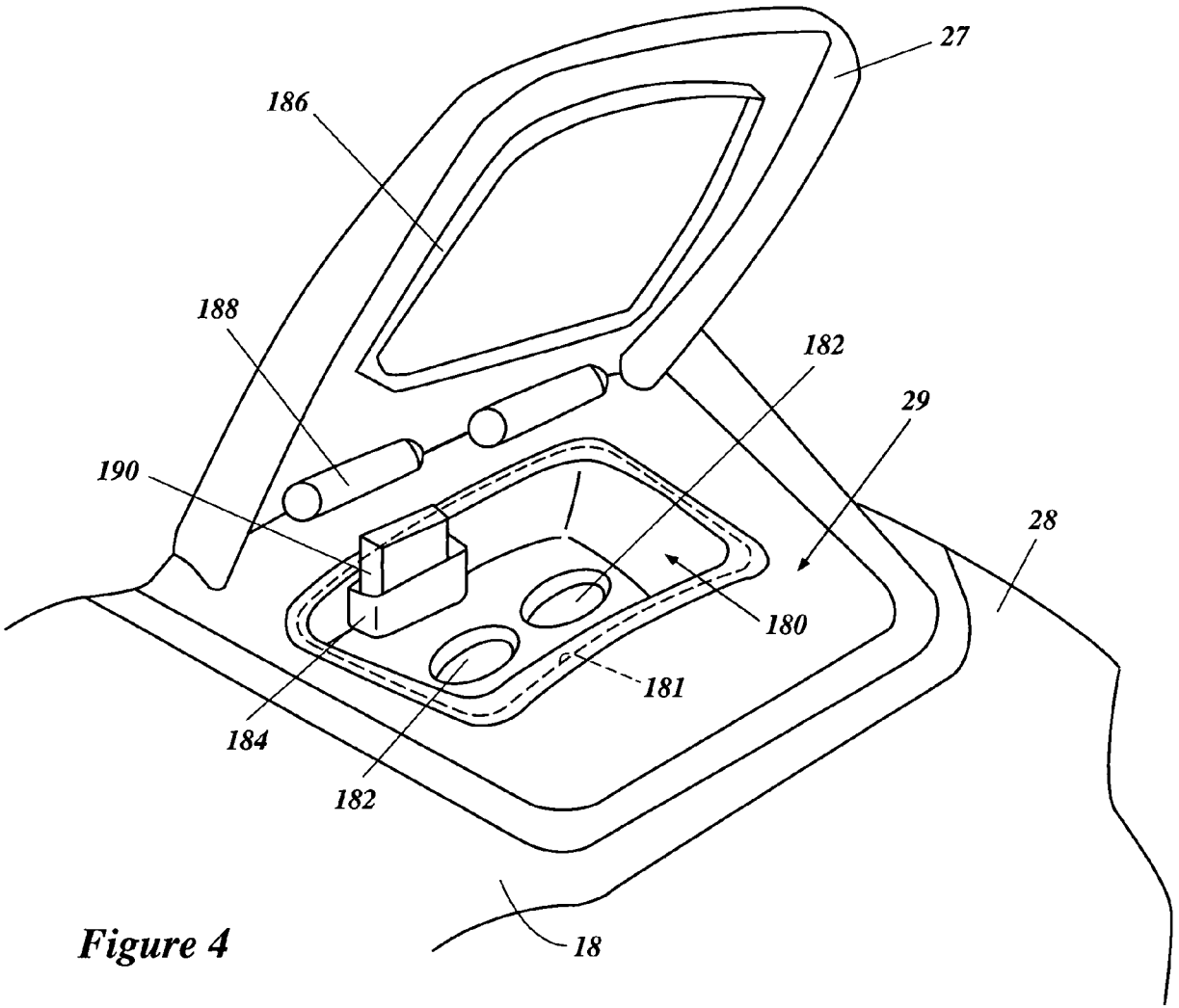
FIG. 4 is a perspective view of an enclosed compartment on the personal watercraft that has a receptacle configured to hold the portable transmitter.

As shown in FIG. 4, a cup holder 180 is positioned inside an opening 181 and has at least one receptacle 182 for securing a generally cylindrical container such a cup, a can, or a bottle. The cup holder 180 preferably defines an insertable component that can be placed in the small storage compartment 29. The cup holder 180 advantageously includes a holder 184 that receives and secures a portable transmitter unit 190. For example, the operator can store the portable unit 190 in the holder 184 during watercraft operation or while the watercraft 10 is being stored. The holder 184 provides a designated place inside the small storage compartment 29 for the transmitter to reduce misplacement of the portable unit 190. A sealing member 186 is advantageously positioned on an inside surface of the cover 27 to prevent water intrusion into the storage compartment 29. The lid 27 covers the small storage compartment 29 and generally inhibits or substantially prevents water from entering the small storage compartment 29. In either case, the lid 27 decreases the likelihood of water entering the small storage compartment 29. The cover 27 is attached to the watercraft through a pair of hinges 188 that allow the cover 27 to be opened and closed.

Figure 5:
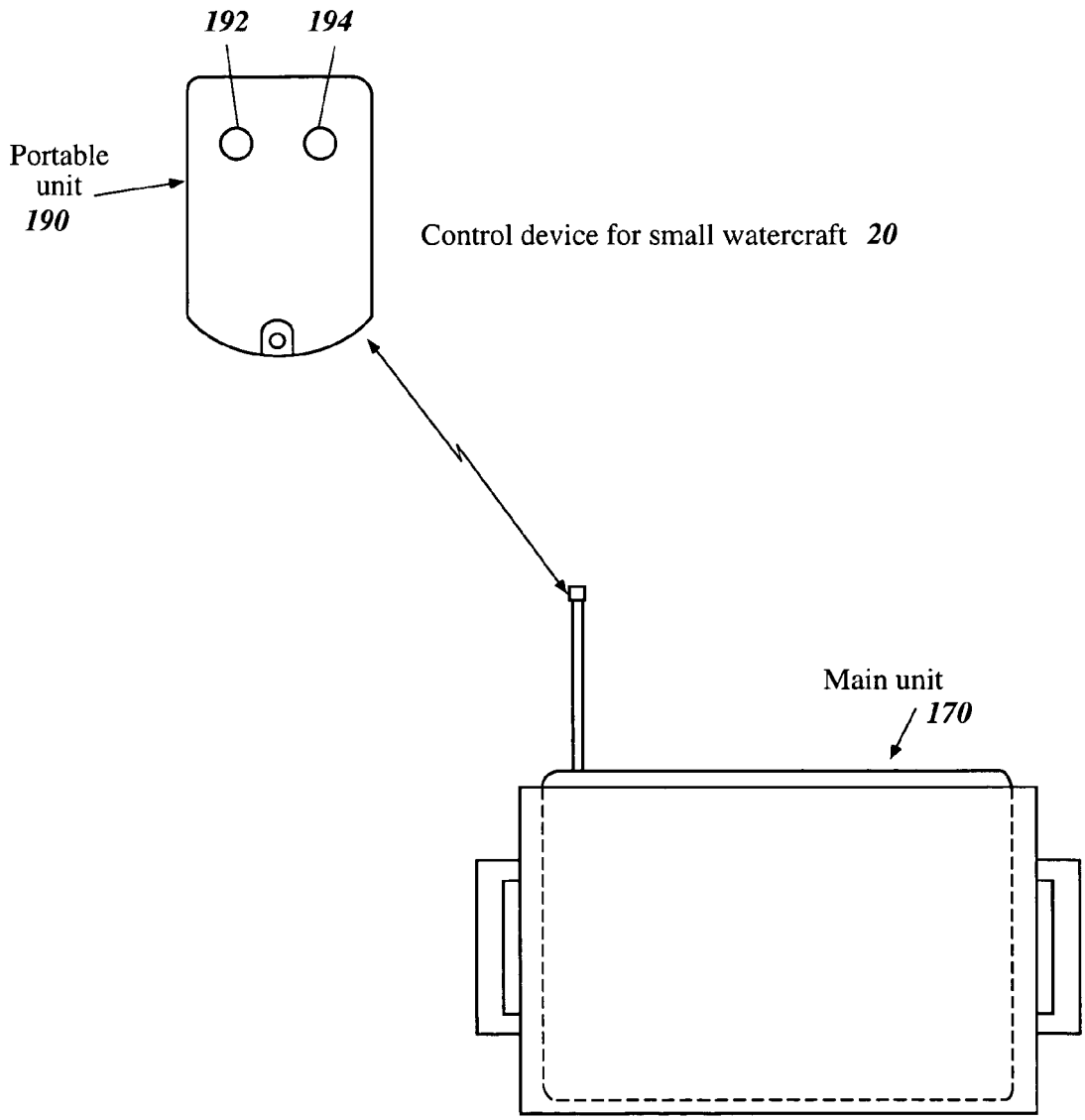
FIG. 5 is a schematic view of the security system and illustrates the interaction between the transmitter and the receiver.

FIG. 5 illustrates the transmitter 190 and main unit or receiver 170. When the transmitter or portable unit 190 is within a predetermined distance range of the main unit 170, the main unit is able to receive signals from the portable unit 190. The signals sent by the portable unit 190 and received by the main unit 170 are further communicated to the ECU 98. The ECU 98 accordingly permits or prevents the engine 12 from being started. According to another preferred embodiment, signals can also be sent by the main unit 170 and received by the portable unit 190.

Figure 6:
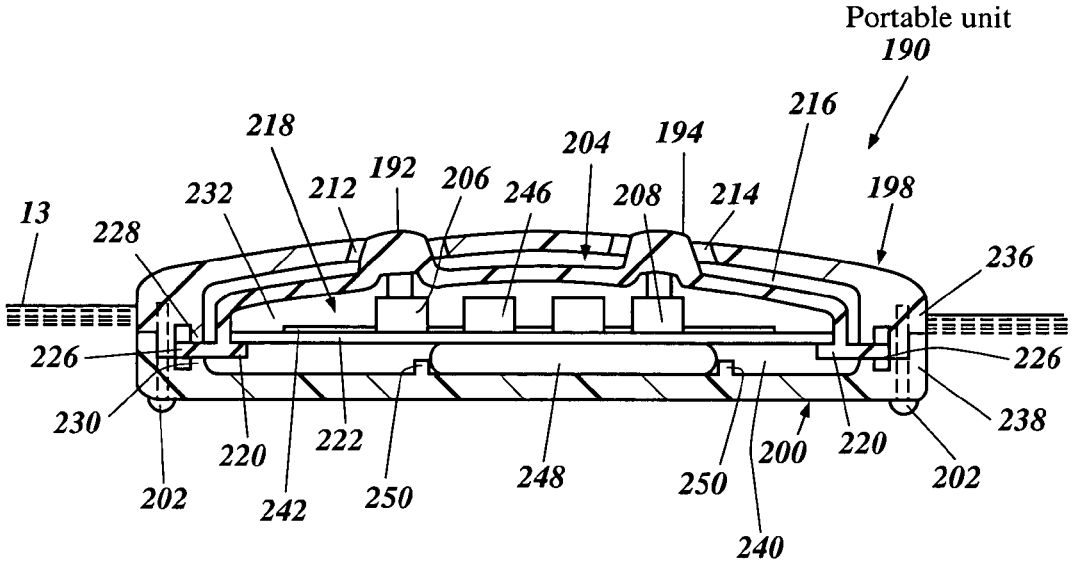
FIG. 6 is a cross-sectional view of the portable transmitter unit of the security system of FIG. 1 with several of the internal components of the portable unit (e.g. a battery and various buttons) shown.

One arrangement of the portable unit 190 comprises a lock button 192 and an unlock button 194. When the main unit 170 and the portable unit 190 have established communication with each other (e.g., an identifying information input signal transmitted from the portable unit 190 has been identified by the main unit 170), the transmitter is able to transmit various signals to the main unit 170. The various signals and preferred embodiments of the security system operation are explained below FIG. 6 illustrates a cross-sectional view of the portable unit 190. An upper portable unit housing 198 is connectable to a lower portable unit housing 200. In one preferred embodiment illustrated in FIG. 6, the upper housing 198 and the lower housing 200 are connected together by small screws 202 or other suitable mechanical fasteners. Other possibilities of securing the upper housing 198 to the lower housing 200 are also possible. For instance, rivets, mechanical interlocking structures and other fastening system can also be used. The portable unit 190 can have any suitable configuration. One advantageous configuration is the illustrated box-like configuration in FIG. 6. Other configurations are discussed below.

As further shown in FIG. 6, a rubber diaphragm 204 is formed in such a way to incorporate the lock button 192 and the unlock button 194. The incorporated lock button 192 is positioned directly above a lock switch 206. Likewise, the incorporated unlock button 194 is positioned directly above an unlock switch 208. Activating the lock button 192 transfers movement directly to the lock switch 206. Activating the unlock button 194 transfers movement directly to the unlock switch 208.

The upper housing 198 comprises a lock button hole 212 and an unlock button hole 214 that allow the lock button 192 and the unlock button 194, respectfully, to protrude through the upper housing 198. These lock and unlock button holes 212, 214 allow the lock button 192 and the unlock button 194 to be activated while protecting the inner components of the portable unit 190. The holes 212, 214 can allow water to enter a non-watertight cavity 216 that is located between the upper housing 198 and the rubber diaphragm 204. The rubber diaphragm 204 prevents water from entering a watertight cavity 218 from the non-water tight cavity 216.

The watertight cavity 218 comprises a predetermined volume that holds a predetermined amount of air. The predetermined amount of air determines a predetermined density of the portable unit 190. The predetermined density of the portable unit 190 allows the portable unit 190 to be less dense than surrounding water and therefore allows the portable unit 190 to be buoyant. The buoyancy of the portable unit 190 allows the portable unit to float on the surface of the water and to be easily found if the portable unit 190 should fall overboard from the watercraft 10.

The rubber diaphragm 204 also includes inner tabs 220 that support a base plate 222 and outer tabs 226 that are sandwiched in between the upper housing 198 and the lower housing 200. The outer tabs 226 are compressed by the upper housing 198 through an upper compression tab 228 and by the lower housing 200 through a lower compression tab 230. The upper compression tab 228 and the lower compression tab 230 compress the outer tabs 226 to provide an upper watertight cavity 232 that is part of the watertight cavity 218. An upper positioning portion 236 on the upper housing 198 corresponds to and is aligned with a lower positioning portion 238 on the lower housing 200. The upper positioning portion 236 and the lower positioning portion 238 provide correct alignment between the upper housing 198 and the lower housing 200 to advantageously position the diaphragm 202 between the upper housing 198 and the lower housing 200.

The base plate 222 is supported by the inner tabs 220 of the rubber diaphragm 202. The base plate 222 is positioned in the upper housing 198 and in the lower housing 200 to preferably separate the watertight cavity 218 into the upper watertight cavity 232 and a lower watertight cavity 240. The base plate 222 supports a circuit board 242 that provides a mounting surface for the lock switch 206, the unlock switch 208, and other electrical components 246. The circuit board, the switches 206, 208, and the electrical components 246 are positioned inside the upper watertight cavity 232.

A small battery 248 makes contact with the circuit board 242 through the base plate 222. The battery 248 is positioned directly below the base plate 222 in the lower watertight cavity 240. The battery 248 is held in position by the base plate 222, the lower housing 200, and two battery positioning tabs 250. The battery 248 provides adequate power to allow the portable unit 190 to communicate with the main unit 170.

Figure 7:
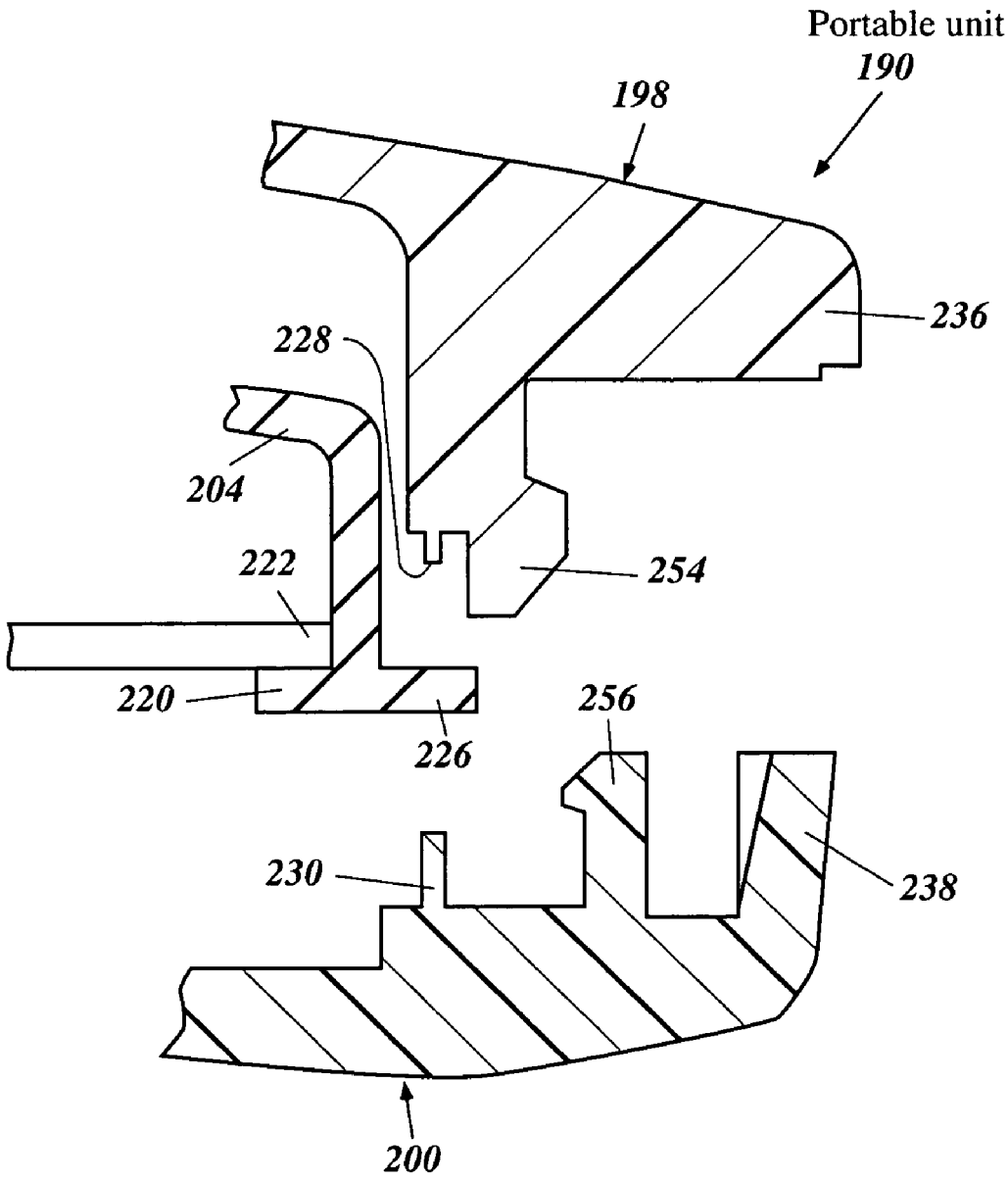
FIG. 7 is an enlarged partial view of various parts and a coupling mechanism of the portable unit.

FIG. 7 illustrates an enlarged cross-sectional view of a portion of the portable unit 190 to illustrate an advantageous system for connecting the upper portable unit housing 198 to the lower portable unit housing 200. In the embodiment illustrated in FIG. 7, the upper housing 198 and the lower housing 200 are connected together using an upper locking tab 254 and a corresponding lower locking tab 256. The upper positioning portion 236 on the upper housing 198 corresponds to and is aligned with the lower positioning portion 238 on the lower housing 200. The upper positioning portion 236 and the lower positioning portion 238 provide correct alignment between the upper housing 198 and the lower housing 200. The correct alignment of the upper housing 198 and the lower housing 200 advantageously positions the upper locking tab 254 and the corresponding lower locking tab 256. The connection of the upper locking tab 254 and the lower locking tab 256 assures a secure attachment between the upper housing 198 and the lower housing 200.

Figure 8:
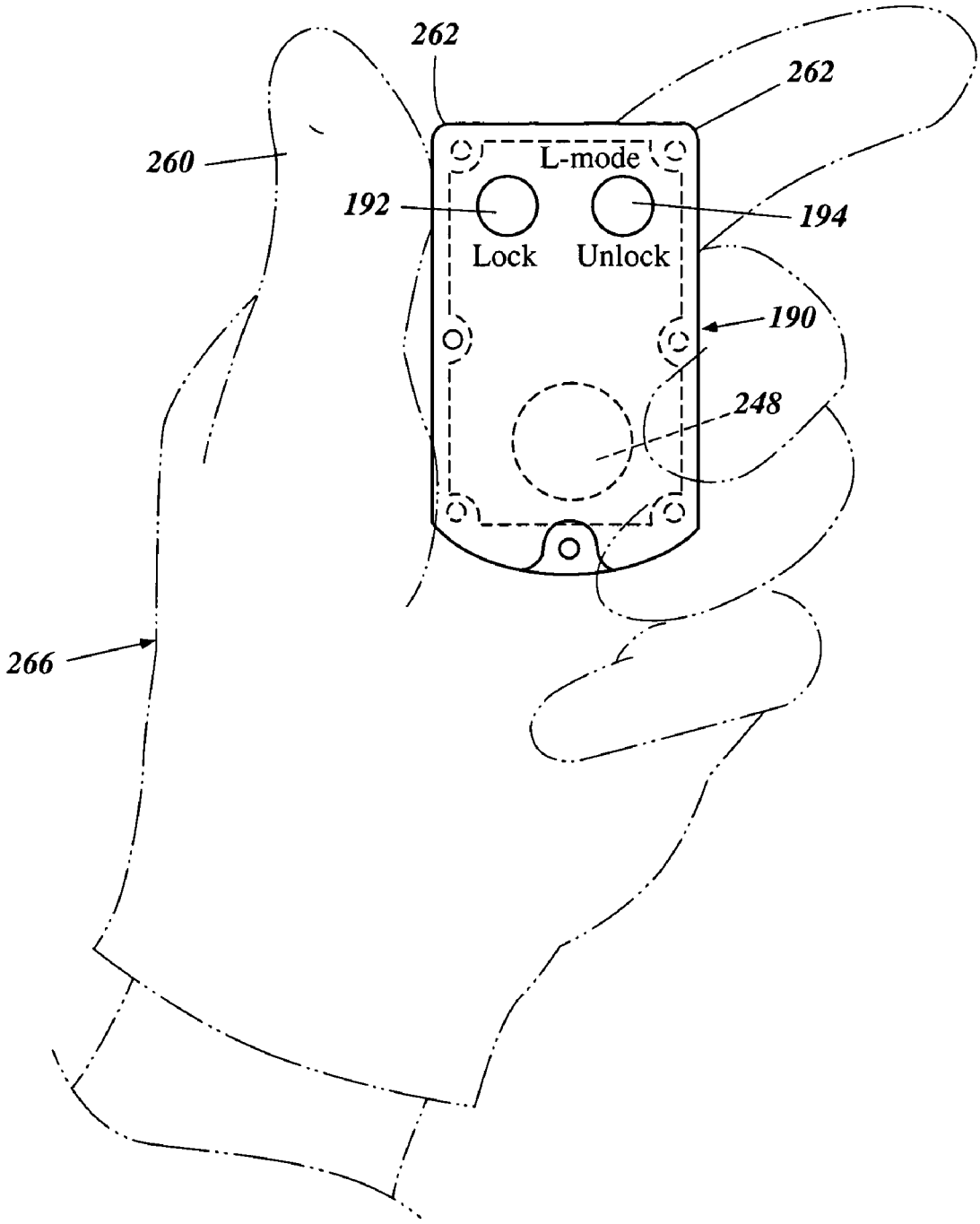
FIG. 8 is a front plan view of the portable unit illustrating various buttons and an exemplifying size of the portable unit with respect to an operator's hand.

FIG. 8 illustrates a preferred way for an operator to hold the portable unit 190 when the portable unit 190 is being used. An operator's hand holds the portable unit 190 so that the operator is able to manipulate the lock button 192 and the unlock button 194 with the thumb 260. A preferred shape of the portable unit 190 includes distinct corners 262 that allow the operator's hand to firmly grip the portable unit 190 in all environmental conditions, including, for example, wet conditions. The portable unit 190 is easily controlled even when a glove 266 is worn on the hand holding the portable unit 190. Regardless of the environment (e.g., even when the operator is wearing a glove), the portable unit 190 is easily used to communicate commands to and from the main unit 170.

Figure 9:
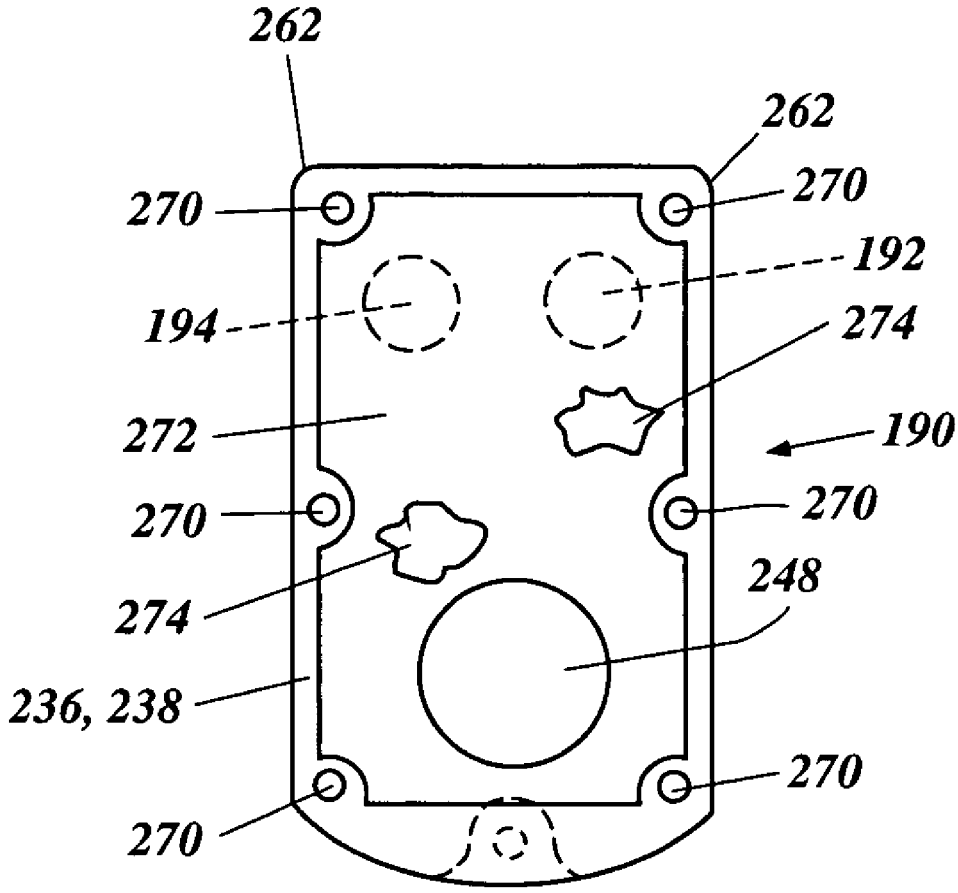
FIG. 9 is a rear plan view of the portable unit of FIG. 8 illustrating the presence of water droplets that are visible through the transparent housing.

FIG. 9 illustrates the reverse side of the portable unit 190 of FIG. 8. As shown in FIG. 9, a plurality of small screw receptacles 270 receive the screws 202 (FIG. 6) that securely fasten the upper housing 198 and the lower housing 200 together. As further illustrated in FIG. 9, the portable unit 190 has a transparent body 272 that allows the operator to see the internal components of the portable unit 190. The transparent body 272 also allows the operator to see any water droplets 274 that may have inadvertently entered the housing of the portable unit 190. If the operator detects the presence of any water droplets 274 in the portable unit 190, the operator can quickly disassemble the portable unit 190 and dry the internal components of the portable unit 190.

Figure 10A:
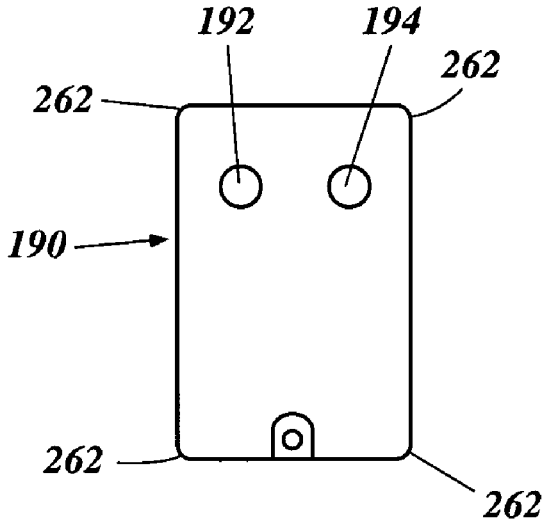
FIG. 10A is front elevational view illustrating a rectangular shape of the portable unit configured in accordance with certain features, aspects and advantages of the present invention.
Figure 10B:
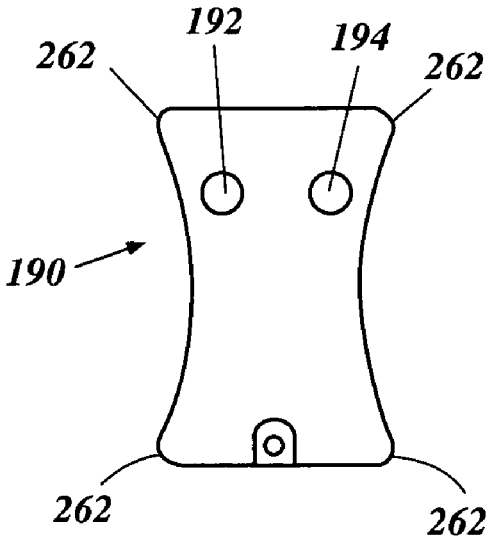
FIG. 10B is a front elevational view illustrating an hourglass shape of the portable unit configured in accordance with certain features, aspects and advantages of the present invention.

FIGS. 10A and 10B illustrate various preferred shapes of the portable unit 190. A rectangular-shaped embodiment of the portable unit 190 in FIG. 10A includes the distinct corners 262 that enable the operator to firmly grip the portable unit 190 in all environmental conditions, including wet conditions. An hourglass-shaped embodiment illustrated in FIG. 10B also includes the distinct corners 262 and enables the operator to firmly grip the portable unit 190 in all environmental conditions, including wet conditions.

Figure 11A:
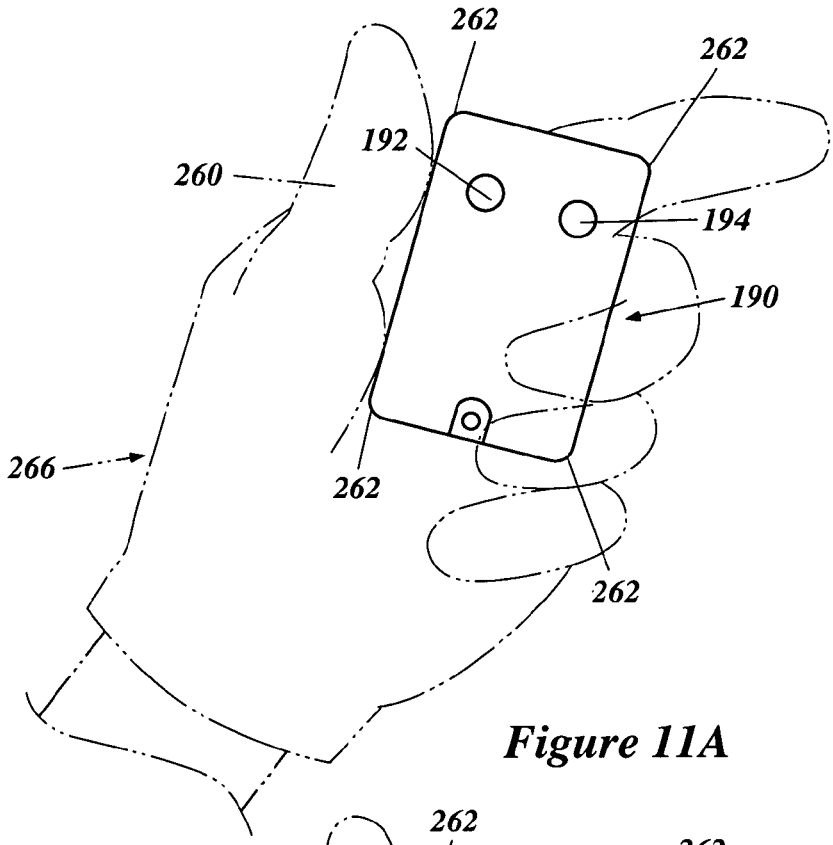
FIG. 11A is a front elevational view of the rectangular shaped portable unit illustrating various buttons and exemplifying the size of the portable unit with respect to an operator hand.
Figure 11B:
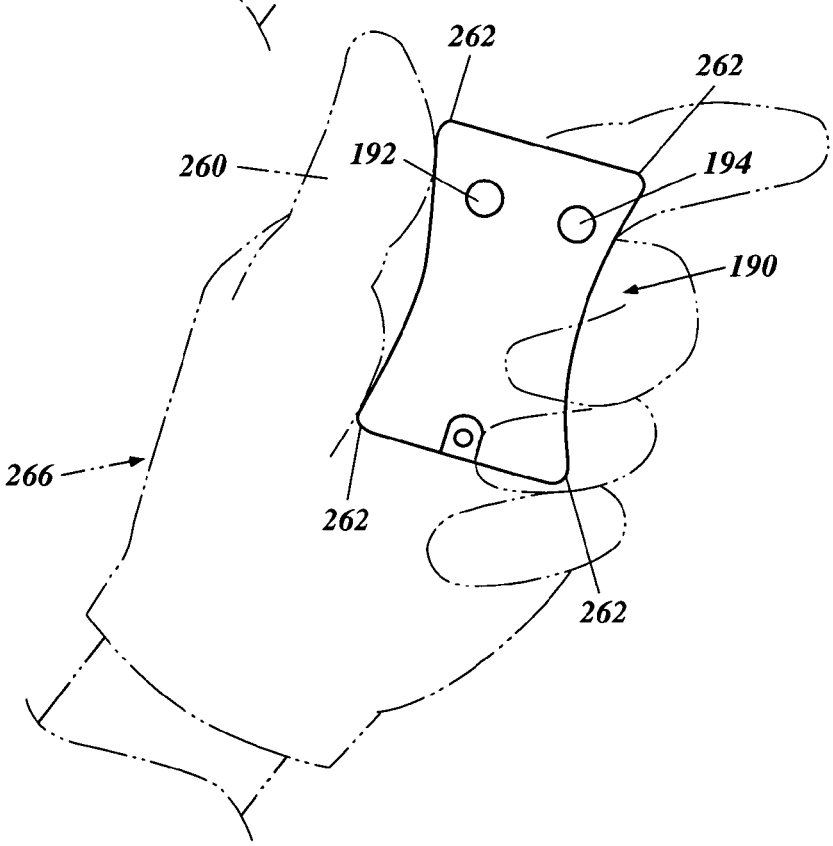
FIG. 11B is a front elevational view of the hourglass shaped portable unit illustrating various buttons and exemplifying the size of the portable unit with respect to an operator hand.

FIGS. 11A and 11B illustrate embodiments of the portable unit 190 shown in FIGS. 10A and 10B when held by an operator. Both the conventional rectangular shape illustrated in FIG. 11*a* and the hourglass shape illustrated in FIG. 11*b* fit conveniently in the hand of the operator. Both shapes allow the operator to firmly grip the portable unit 190 in all environmental conditions including wet conditions and to easily and effectively manipulate the lock button 192 and the unlock button 194. Regardless of the environment, the operator can operate the portable unit 190 to communicate commands to and from the main unit 170.

Figure 12A:
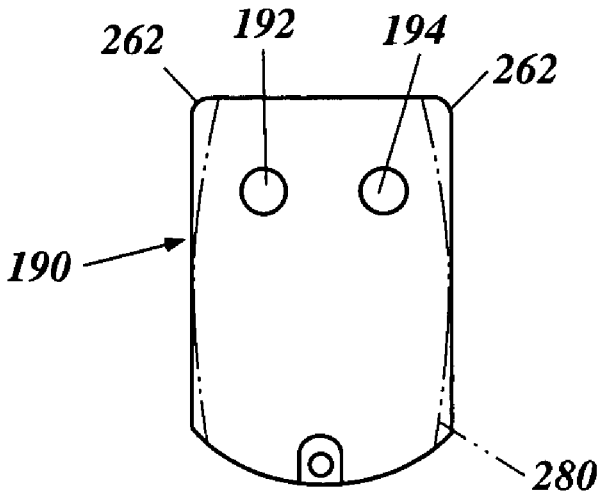
FIG. 12A is a front elevational view illustrating another shape of the portable unit configured in accordance with certain features, aspects and advantages of the present invention.
Figure 12B:
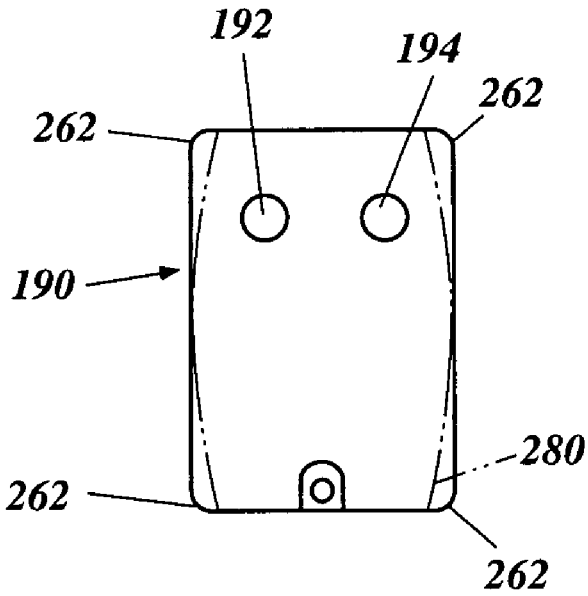
FIG. 12B is a front elevational view illustrating another shape of the portable unit configured in accordance with certain features, aspects and advantages of the present invention.

FIGS. 12A and 12B illustrate other advantageous shapes of the portable unit 190. A portable unit 190 having a slightly rounded shape is illustrated in FIG. 12A. The slightly rounded shape also enables the operator to firmly grip the portable unit 190 in all environmental conditions, including wet conditions. The embodiment having the slightly rounded shape illustrated in FIG. 12A and an embodiment having a rectangular shape, illustrated in FIG. 12B, both incorporate a contoured surface 280 that further enhances the operator's ability to firmly grip the portable unit 190 in all environmental conditions, including wet conditions.

FIG. 13 illustrates a schematic block diagram that shows various electronic components of the watercraft, including components of the security system 11. In the illustrated arrangement, the security system 11 comprises the main unit 170, the ECU 98, the portable unit 190, the display 176 and a voltage adjusting circuit section or regulator 282. The voltage regulator 282 regulates the voltage of a watercraft battery 284 to provide the various electronic components of the security system 11 with an appropriate operating voltage. A verification system is advantageously located inside the ECU 98 and is capable of determining whether a transmitter (e.g., the portable unit 190) is allowed to communicate with the security system 11. In certain arrangements, the verification system utilizes a rolling access code. In other advantageous arrangements, the verification system uses fixed signals. All signals received from and sent to the portable unit 190 from the security system 11 are communicated through an antenna 286. The antenna is described below.

Figure 14:
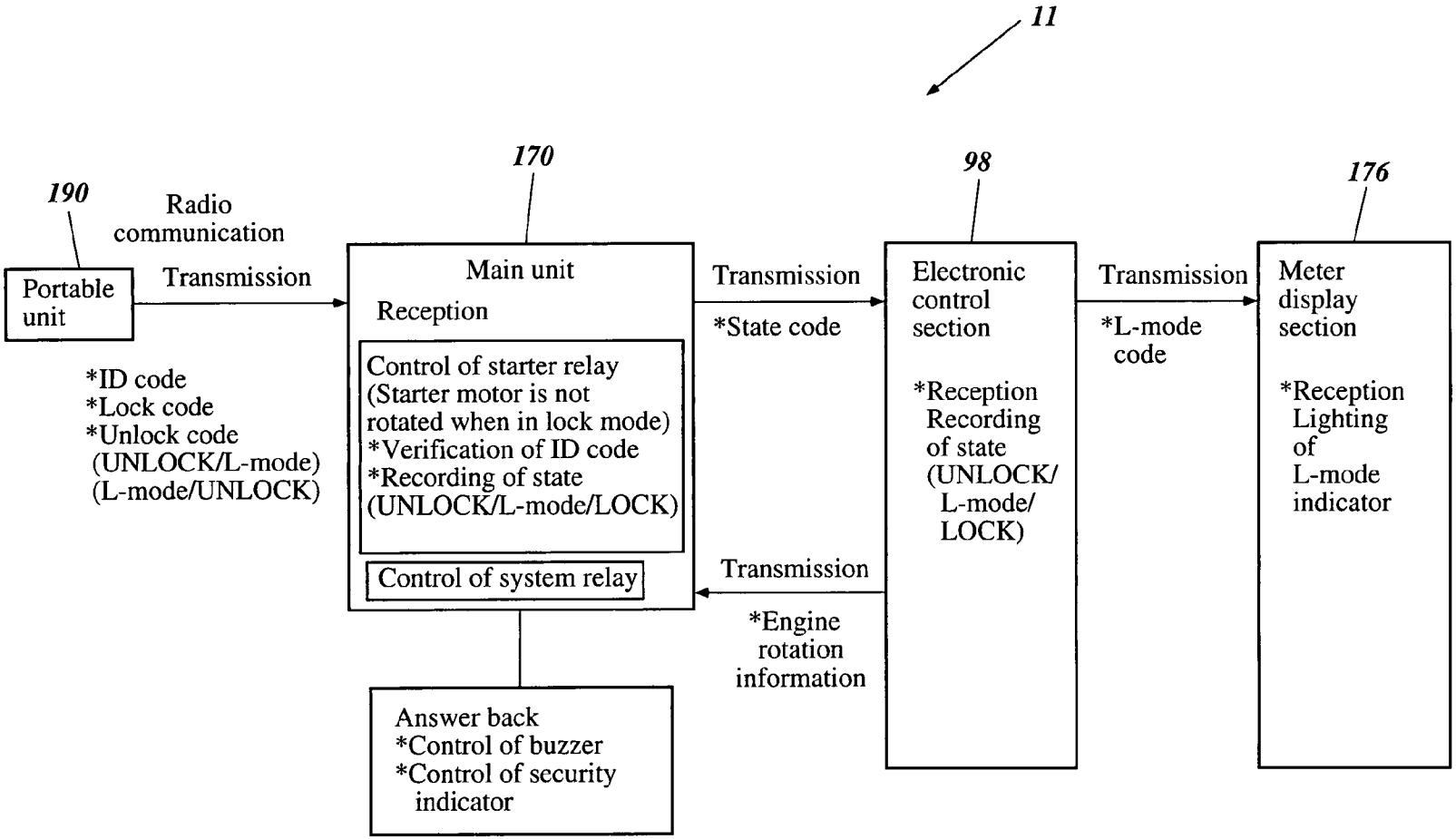
FIG. 14 is a flow diagram that illustrates the communication between the portable unit, the main unit, the electronic control section, and a display section.

FIG. 14 is a flow diagram that illustrates the communication and operation of the security system 11. The portable unit 190 sends a transmission signal to the main unit 170 that comprises various codes. For example, an ID code, a lock code, an unlock code, or other predetermined codes can be wirelessly transmitted from the portable unit 190 to the main unit 170. The main unit 170 receives the wireless transmission from the portable unit 190 and begins control of a starter relay 288. Control of the starter relay advantageously includes verifying the ID code, recording a state, and performing other predetermined functions. The main unit 170 transmits to the portable unit 190 or to various systems on the watercraft to inform the user the state of the watercraft security system 11. The main unit advantageously informs the user of the state of the security system 11 through, for example, a buzzer 287 or various illuminated indicators or a combination of the buzzer and illuminated indicators.

When the main unit 170 receives the code from the portable unit 190, the main unit communicates the code information to the ECU 98. The ECU 98 can communicate back to the main unit 170 various information including engine speed. The ECU 98 can limit engine speed depending on which code has been received by the portable unit 170. The ECU 98 can further communicate with the display 176 to inform the user of which mode the security system is currently operating. The various modes in which the security system 11 and the watercraft 10 operate are described below.

Figure 15:
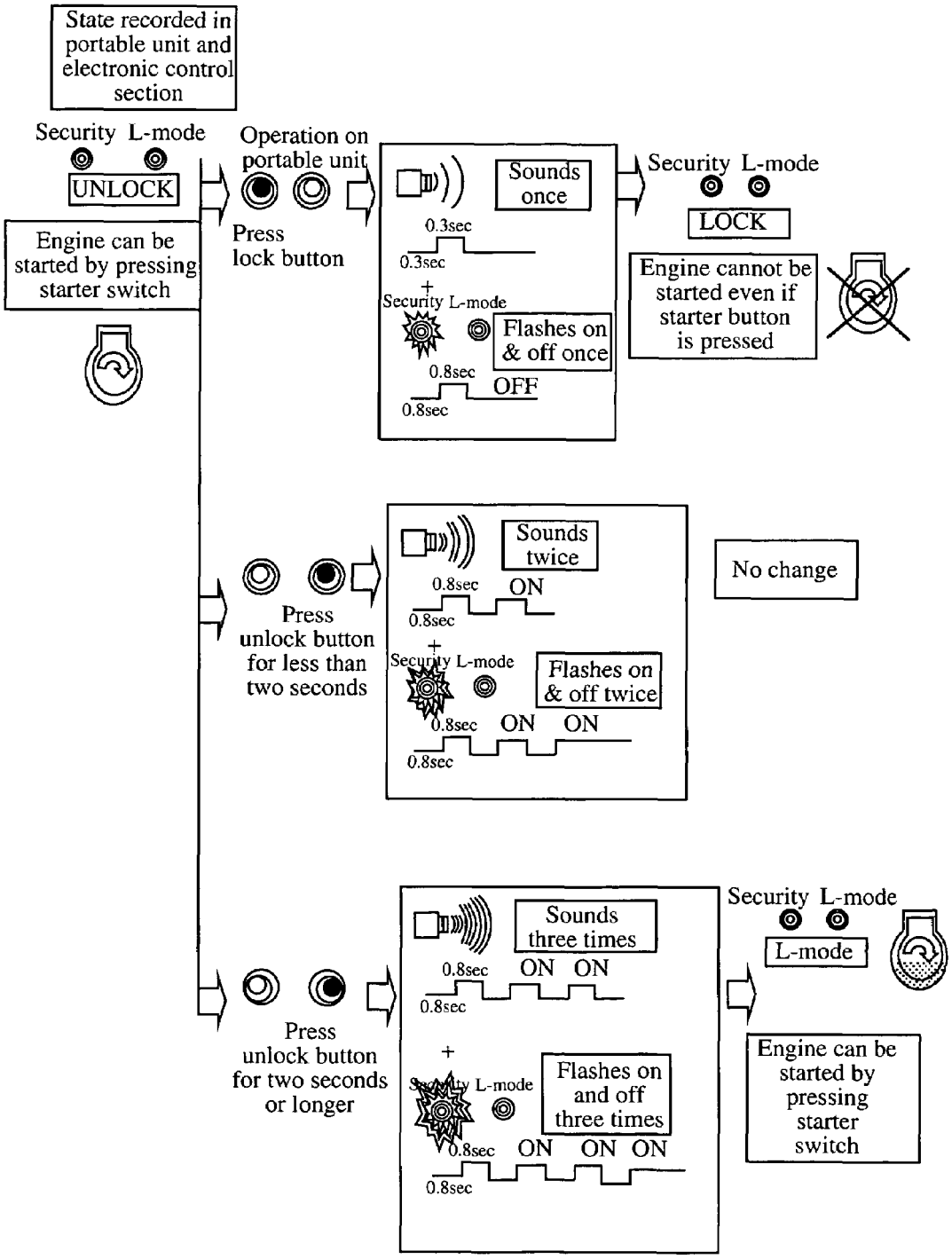
FIG. 15 illustrates a diagram showing the function of an Unlock mode of operation, in which the function of various light emitting diodes (LEDs) and the operation of the engine are shown.
Figure 16:
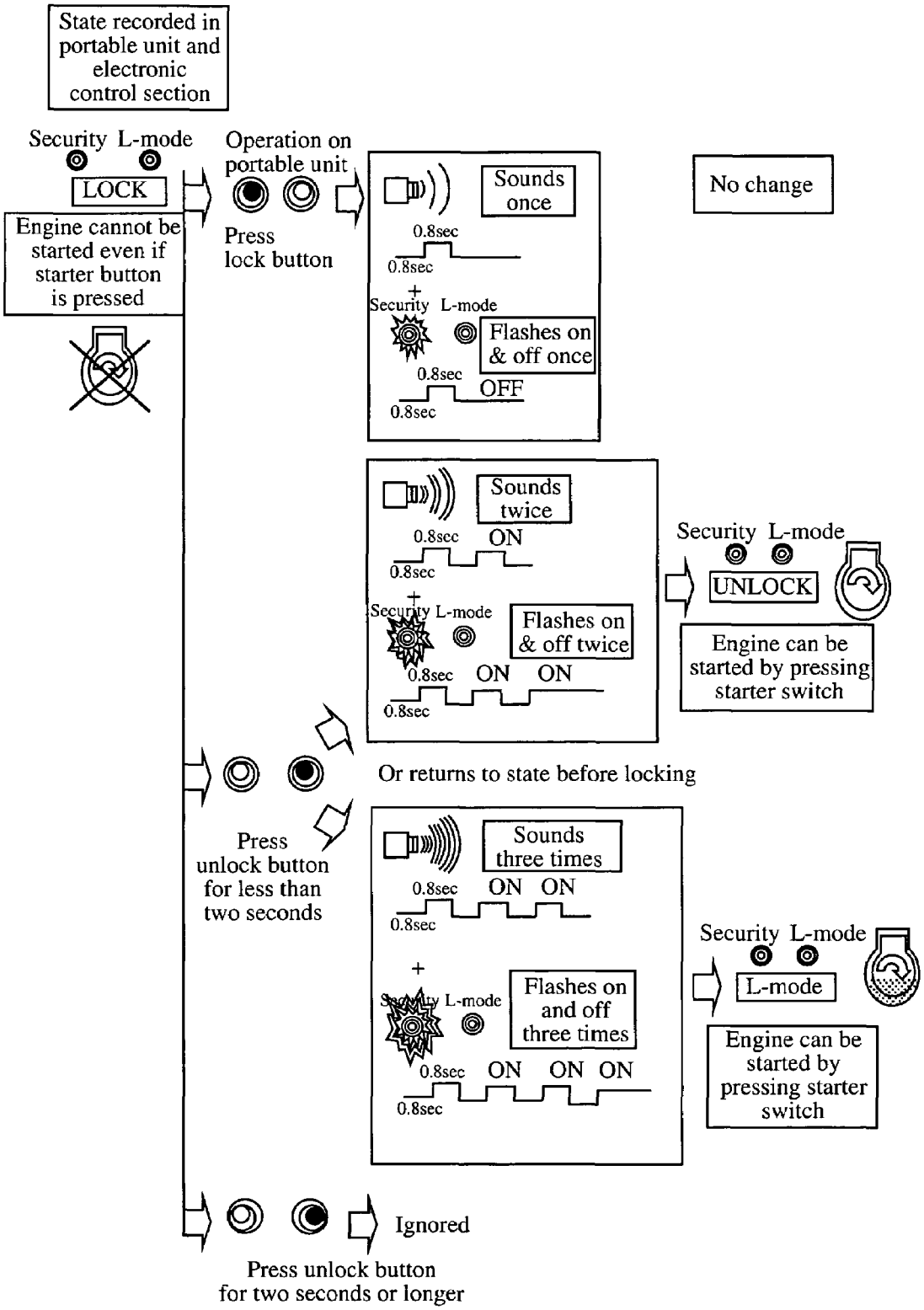
FIG. 16 illustrates a diagram showing the function of a Lock mode of operation, in which the function of various LEDs and the operation of the engine are shown.
Figure 17:
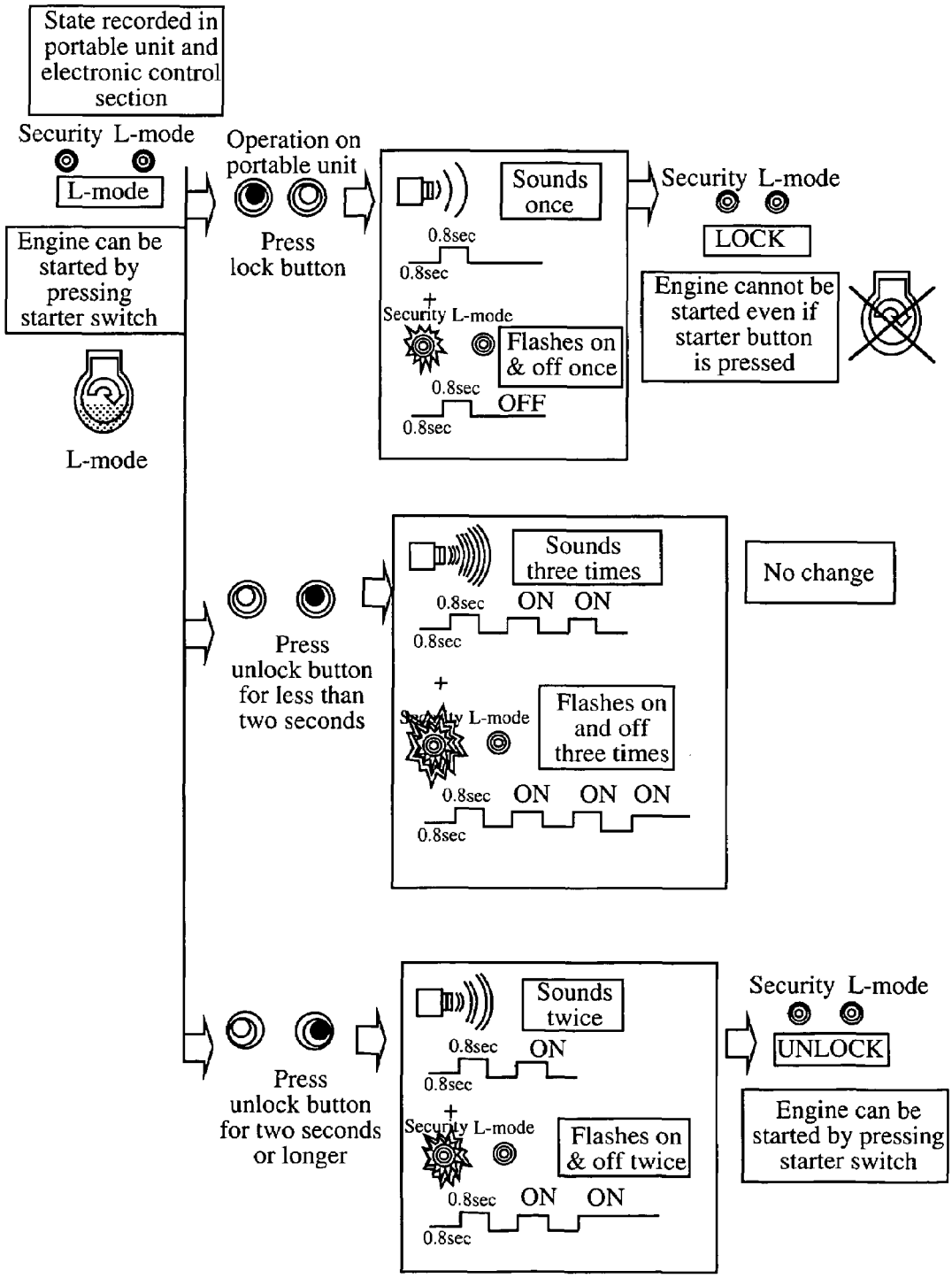
FIG. 17 illustrates a diagram showing the function of an L-mode of operation, in which the function of various LEDs and the operation of the engine are shown.

FIGS. 15 through 17 illustrate the operation of the various modes of operation of the security system 11. The operator may selectively activate three different watercraft operational modes by pressing the lock button 192, by pressing the unlock button 194, or by pressing a combination of the lock and unlock buttons. For example, FIG. 15 illustrates an activation of lock mode after the watercraft has been in the unlock mode for a predetermined amount of time. The unlock mode is then activated followed by the activation of an L-mode.

As shown in FIG. 15, when the user presses the lock button 192 on the portable unit 190, the security system 11 activates the buzzer once and illuminates a security indicator 197 on the display 176 for one short interval. When the security system 11 is in the lock mode, the ECU 98 does not allow the engine 12 to start even if the start button is pressed by the operator. When the unlock button is then pressed by the operator for a duration of less than two seconds, the security system 11 sounds the buzzer 287 twice and the security indicator 197 is illuminated for two short intervals. After the unlock button 194 has been pressed by the operator for a duration of less than two seconds, the ECU 98 allows the engine 12 to be started and operated with the full engine speed range by the operator. When the unlock button 194 is then pressed by the operator for a duration of more than two seconds, the security system 11 sounds the buzzer 287 three times and the security indicator 197 is illuminated for three short intervals. After the unlock button 194 has been pressed by the operator for a duration of more than two seconds, the security system 11 allows the watercraft to be operated in the L-mode. When the watercraft is in the L-mode, the ECU 98 allows the engine 12 to be operated only within a predetermined engine speed range regardless of how fast the operator attempt to operate the engine.

In FIG. 16, an activation of the lock mode is shown after the watercraft has been in the lock mode for a predetermined amount of time. The unlock mode is then activated followed by an activation of the L-mode.

When the user presses the lock button 192 on the portable unit 190, the security system 11 activates the buzzer once and illuminates a security indicator 197 on the display 176 for one short interval. When the security system 11 is in the lock mode, the ECU 98 does not allow the engine 12 to start even if the start button is pressed by the operator. When the unlock button 194 is then pressed by the operator for a duration of less than two seconds, the mode that the watercraft was operating immediately before the lock mode is restored. For example, if the mode immediately before the lock mode was the unlock mode, the security system 11 sounds the buzzer 287 twice, the security indicator 197 is illuminated for two short intervals, and the unlock mode is activated. If the mode immediately before the lock mode was the L-mode, the security system 11 sounds the buzzer 287 three times, the security indicator 197 is illuminated for three short intervals, and the L-mode is activated. When the unlock button 194 is pressed for a duration of more than 2 seconds, the operation is ignored and neither the buzzer 287 nor the security indicator 197 is activated.

In FIG. 17, an activation of the lock mode is shown after the watercraft has been in the L-mode for a predetermined amount of time. The unlock mode is then activated.

When the user presses the lock button 192 on the portable unit 190, the security system 11 activates the buzzer 287 once and illuminates a security indicator 197 on the display 176 for one short interval. When the unlock button 194 is then pressed by the operator for a duration of less than two seconds and released, the security system 11 sounds the buzzer 287 three times, the security indicator 197 is illuminated for three short intervals, and the watercraft is returned to the L-mode. When the unlock button is then pressed by the operator for a duration of more than two seconds, the security system 11 sounds the buzzer two times, the security indicator 197 is illuminated for two short intervals, and the watercraft operation is changed to the unlock mode.

Figure 18:
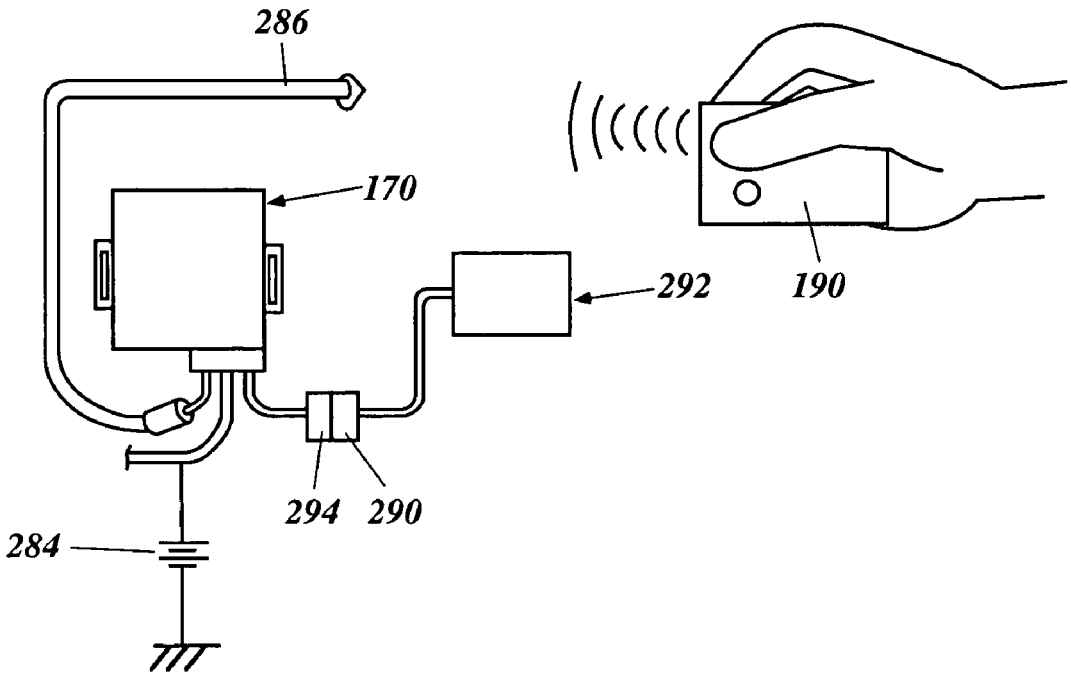
FIG. 18 illustrates the control device for the watercraft including the portable unit and the main unit configured in accordance with certain features, aspects and advantages of the present invention.
Figure 19:
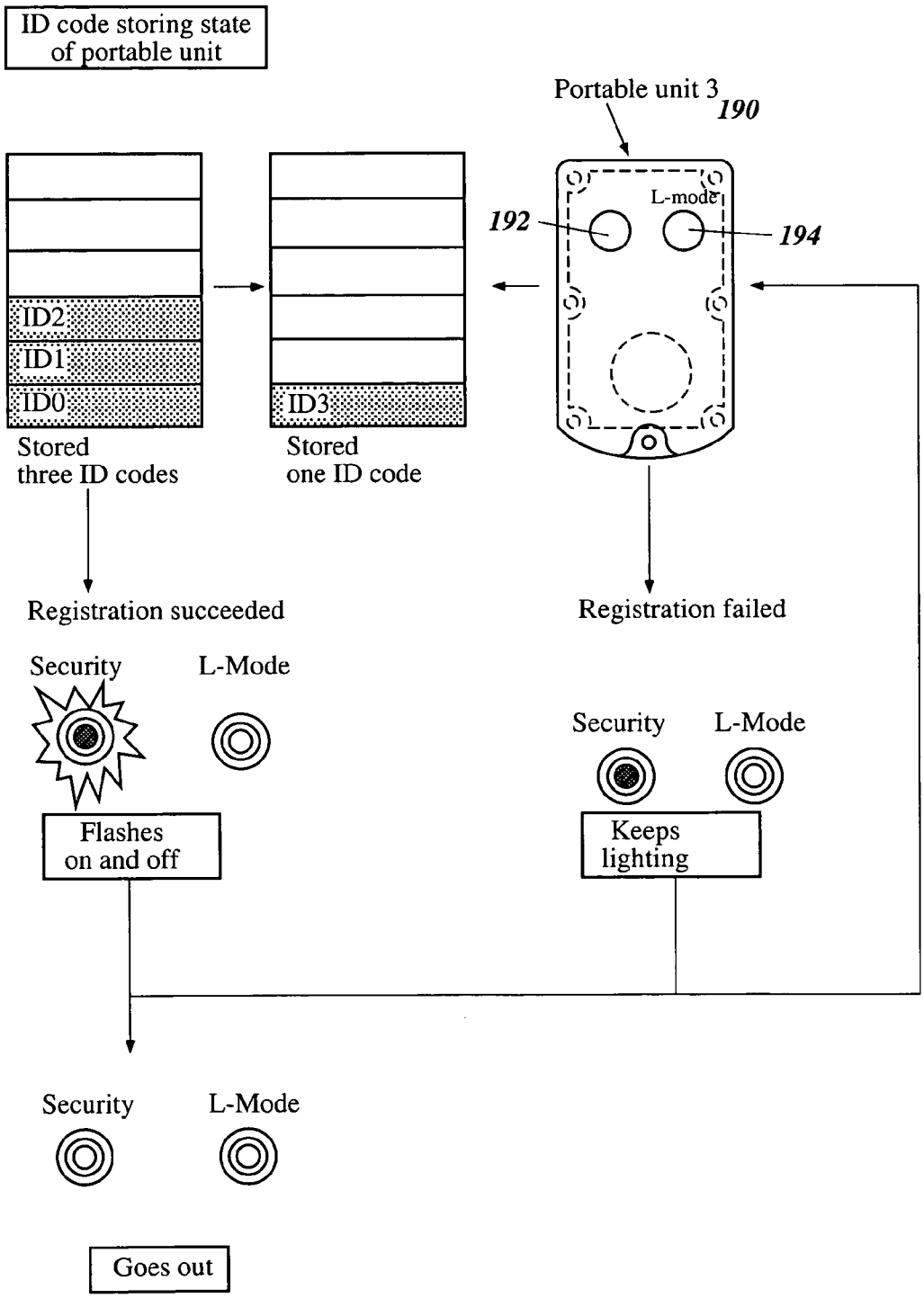
FIG. 19 is a flow diagram illustrating a system for storing identification data of the portable unit and for illuminating various LEDs depending on the status of the watercraft control device.

FIGS. 18 and 19 illustrate a re-registration procedure of the portable unit 190. If the portable unit 190 becomes lost, misplaced, or damaged, the operator may purchase a new portable unit 190 and register the new portable unit 190 with the security system 11 of a particular watercraft. Additional portable units can also be purchased and registered to operate with the security system 11 of a particular watercraft. Additional portable units can be registered with a particular watercraft by connecting a connector 290 of a re-registration unit 292 to a connector 294 that is attached to the main unit 170. According to one preferred embodiment, a new ID code from the new portable unit is registered with the main unit 170 through the re-registration unit 292 by pressing the lock button 192 or the unlock button 194. Once the new ID code has been registered with the main unit 170 through the re-registration unit 292, the new portable unit 190 is able to communicate with the security system 11. The main unit can store a plurality of ID codes in a memory. In one preferred embodiment, the main unit 170 can store up to a predetermined number of ID codes for a predetermined number of individual portable units. If the operator attempts to register more than the predetermined number of ID codes, the registration of the portable units registered after the predetermined number of portable units will fail.

The security indicator 197 informs the operator when the new or additional portable units have been successfully registered with the main unit 170. When the additional portable unit 190 is successfully registered with the main unit 170, the security indicator 197 is illuminated for one short period. If, however, the additional portable unit 190 is not successfully registered with the main unit 170, the security indicator 197 is illuminated and remains illuminated for a predetermined amount of time.

In another embodiment, the portable unit 190 communicates directly with the main unit 170 through the cable 112. In such an embodiment, the main unit 170 is advantageously configured to be a portable device carried by the operator. The main unit or receiver 170 advantageously incorporates the lock button 192 and the unlock button 194 and communicates with the portable unit 190 to lock or unlock the operation of the engine 12. The main unit 170 can also be positioned in the holder 184. The operator can store the main unit 170 in the holder 184 during watercraft operation or while the watercraft 10 is being stored. The holder 184 provides a designated location inside the small storage compartment 29 for the receiver to reduce the probability of misplacing the main unit 170.

The antenna 286 is advantageously connected to the main unit 170. The antenna 286 has an extended length that provides improved reception and therefore provides improved communication between the main unit 170 and the portable unit 190. The position of the antenna 286 is selected to prevent the antenna from tangling with other wires or from becoming caught in one of the access lids. In one advantageous arrangement, the antenna 286 is formed as a square, as a rectangle, as a circle or as another suitable closed loop. Other configurations may also be used. The configuration of the illustrated antenna 286 advantageously improves an omnidirectional characteristic of the antenna. Other arrangements that reduce the directional characteristic of the antenna and that enhance the omnidirectional characteristic also can be used. A directional antenna may also be used but is less desirable for most applications. Preferably, the antenna is positioned away from instruments and watercraft components (e.g., an electric bilge pump) that might adversely affect transmission of radio waves to the receiver.

Figure 20A:
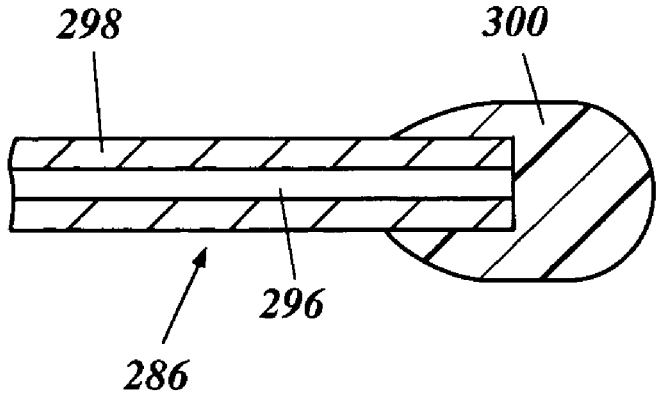
FIG. 20A is a side elevational and sectioned view of one preferred embodiment of an antenna that is configured in accordance with certain features, aspects and advantages of the present invention.
Figure 20B:
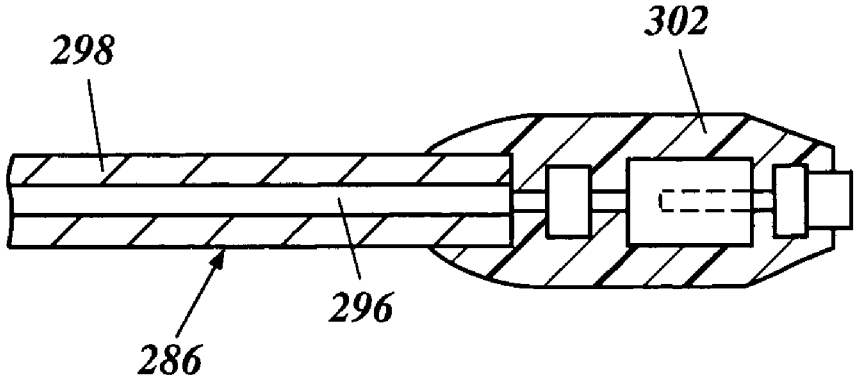
FIG. 20B is a side elevational and sectioned view of another preferred embodiment of an antenna that is configured in accordance with certain features, aspects and advantages of the present invention.

FIG. 20A illustrates a preferred embodiment of the antenna 286. The antenna 286 comprises an internal wire portion 296 surrounded by a protective resin layer 298. The antenna 286 illustrated in FIG. 20*a* comprises a rounded resin molded end 300 that protects the end of the internal wire portion 296 and promotes safe use by the operator.

FIG. 20A illustrates another preferred embodiment of the antenna 286. The end of the antenna 286 comprises a waterproof connector 302. The waterproof connector 302 prohibits water from entering the antenna and contacting the internal wire portion 296. The waterproof connector 302 also allows one or more extension antennas to be connected to the antenna 286. The addition of an extension antenna can increase the communication distance between the portable unit 190 and the main unit 170.

Although the present invention has been described in terms of a certain preferred embodiments, other embodiments apparent to those of ordinary skill in the art also are within the scope of this invention. Thus, various changes and modifications may be made without departing from the spirit and scope of the invention. Moreover, not all of the features, aspects and advantages are necessarily required to practice the present invention. Accordingly, the scope of the present invention is intended to be defined only by the claims that follow.

What is claimed is:

1. A watercraft comprising a hull, a seat, a control mast, an engine disposed within the hull, a controller that communicates with at least one engine parameter and that is configured to control engine operation, a security system configured to communicate with the engine controller, a receiver that communicates with the security system, and a portable transmitter that transmits at least one signal to the receiver, the portable transmitter comprising at least one sealed airtight cavity that maintains a density of the portable transmitter below the density of water, the security system determining how the engine controller controls the engine in response to a signal received from the receiver, the receiver being located in a remote location above the water level of the watercraft and adjacent to an access opening.

2. The watercraft of claim 1, wherein the signal sent by the transmitter is a signal that prohibits engine operation.

3. The watercraft of claim 1, wherein the signal sent by the transmitter is a signal that permits engine operation.

4. The watercraft of claim 1, wherein the signal sent by the transmitter is a signal that limits engine operation.

5. The watercraft of claim 1, wherein the transmitter is rectangular.

6. The watercraft of claim 1, wherein the transmitter includes a transmitter housing that is at least partially transparent.

7. The watercraft of claim 1, wherein the receiver has an antenna that extends from the receiver.

8. The watercraft of claim 1, wherein the transmitter is removably mounted to the watercraft and the transmitter communicates by radio waves with the receiver.

9. The watercraft of claim 1, wherein the receiver comprises an antenna that is formed in a substantially closed loop configuration.

10. The watercraft of claim 1, wherein the receiver comprises an antenna that includes a connector to extend the antenna.

11. A watercraft comprising a hull, a seat, a control mast, an engine disposed within the hull, a controller that communicates with at least one engine parameter and is configured to control engine operation, a security system configured to communicate with the engine controller, a receiver that communicates with the security system, and a portable transmitter that transmits at least one signal to the receiver, the portable transmitter comprising a housing that it is at least partially transparent, the security system determining how the engine controller controls the engine in response to a signal received from the receiver, the receiver being located in a remote location above the water level of the watercraft and adjacent to an access opening.

12. The watercraft of claim 11, wherein the signal sent by the transmitter is a signal that prohibits engine operation.

13. The watercraft of claim 11, wherein the signal sent by the transmitter is a signal that permits engine operation.

14. The watercraft of claim 11, wherein the signal sent by the transmitter is a signal that limits engine operation.

15. The watercraft of claim 11, wherein the transmitter is rectangular.

16. The watercraft of claim 11, wherein the transmitter is buoyant.

17. The watercraft of claim 11, wherein the transmitter is removably mounted to the watercraft and the transmitter communicates by radio waves with the receiver.

* * * * *